US011219266B2

(12) United States Patent
Bruce

(10) Patent No.: US 11,219,266 B2
(45) Date of Patent: Jan. 11, 2022

(54) ARTICLE OF FOOTWEAR WITH BRAIDED UPPER

(71) Applicant: NIKE, Inc., Beaverton, OR (US)

(72) Inventor: Robert M. Bruce, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 16/207,427

(22) Filed: Dec. 3, 2018

(65) Prior Publication Data

US 2019/0098955 A1 Apr. 4, 2019

Related U.S. Application Data

(63) Continuation of application No. 14/495,252, filed on Sep. 24, 2014, now abandoned, which is a (Continued)

(51) Int. Cl.
*A43B 1/04* (2006.01)
*A43B 23/02* (2006.01)
(Continued)

(52) U.S. Cl.
CPC ..... *A43B 1/04* (2013.01); *A43B 23/0215* (2013.01); *A43B 23/0245* (2013.01);
(Continued)

(58) Field of Classification Search
CPC ..... A43B 1/04; A43B 3/0052; A43B 7/1495; A43B 23/0245; A43B 23/0205; D04B 1/26; D04B 1/265; A41B 11/003; A61F 13/08
See application file for complete search history.

(56) References Cited

U.S. PATENT DOCUMENTS 165,941 A 7/1875 Malhebe
329,739 A 11/1885 Heostkels
(Continued)

FOREIGN PATENT DOCUMENTS

BE 426458 A 3/1938
CN 86209002 U 10/1987
(Continued)

OTHER PUBLICATIONS

International Search Report and Written Opinion dated Apr. 15, 2019 in International Patent Application No. PCT/US2018/061502, 18 pages.
(Continued)

*Primary Examiner* — Megan E Lynch
(74) *Attorney, Agent, or Firm* — Shook Hardy & Bacon, L.L.P.

(57) ABSTRACT

An article of footwear includes a braided upper comprised of a unitary braided structure. The unitary braided structure of the braided upper may be engineered with specific features tailored to particular activities. Different regions of the upper may have different braided configurations. For example, higher braid densities may be used in specific areas of the footwear to provide additional structural support or compression. Also, strands of a different material may be incorporated in different regions of the braided upper to provide specific properties to the footwear in those areas.

18 Claims, 24 Drawing Sheets

Related U.S. Application Data continuation of application No. 14/163,392, filed on Jan. 24, 2014, now abandoned.

(60) Provisional application No. 61/839,097, filed on Jun. 25, 2013.

(51) Int. Cl.
*A43B 23/04* (2006.01)
*D04C 1/06* (2006.01)

(52) U.S. Cl.
CPC ..... *A43B 23/0295* (2013.01); *A43B 23/04* (2013.01); *A43B 23/042* (2013.01); *D04C 1/06* (2013.01); *D10B 2501/043* (2013.01)

(56) References Cited

U.S. PATENT DOCUMENTS 376,372 A 1/1888 Dodge
509,241 A 11/1893 Paokaed
586,137 A 7/1897 Medger
621,922 A 3/1899 Kelsall
972,718 A 10/1910 Rahm
1,182,325 A 5/1916 Vinco
1,318,888 A 10/1919 Carpentier
1,527,344 A 2/1925 Bente et al.
1,538,160 A 5/1925 Bosebeck
1,540,903 A 6/1925 Santoyo
1,554,325 A 9/1925 Bente
1,583,273 A 5/1926 Bosebeck
1,597,934 A 8/1926 Stimpson
1,600,621 A 9/1926 Buek, Jr.
1,622,021 A 3/1927 Birkin et al.
1,637,716 A 8/1927 Turck
1,663,319 A 3/1928 Snell
1,687,643 A 10/1928 Berliner
1,713,307 A 5/1929 Stritter
1,717,183 A 6/1929 Brenner
1,730,768 A 10/1929 Heyman
1,803,554 A 5/1931 Knilans
1,828,320 A 10/1931 Daniels
1,832,691 A 11/1931 David
1,864,254 A 6/1932 Meyer
1,877,080 A * 9/1932 Teshima ..... A43B 5/18 36/7.5
1,887,643 A 11/1932 Huber
1,949,318 A 2/1934 Markowsky
2,001,293 A 5/1935 Wallace
2,022,350 A 11/1935 Huber
2,091,215 A 8/1937 Price
2,144,689 A 1/1939 Ferguson
2,147,197 A 2/1939 Glidden
2,161,472 A 6/1939 Hurwit
2,162,472 A 6/1939 Scharf
2,165,092 A * 7/1939 Daniels ..... A43B 23/0205 36/3 A
2,188,640 A 1/1940 Bloch et al.
RE21,392 E 3/1940 Hurwit
2,271,888 A 2/1942 Manley
2,311,959 A 2/1943 Nurk
D137,767 S 4/1944 Goldstein
2,382,559 A * 8/1945 Goldstein ..... A43B 1/02 36/3 A
2,412,808 A * 12/1946 Goldstein ..... A43B 1/04 36/11.5
2,521,072 A 9/1950 Lovell
D164,847 S 10/1951 Dronoff
2,586,045 A 2/1952 Hoza
2,617,129 A 11/1952 Petze
2,641,004 A 6/1953 Whiting et al.
2,675,631 A 4/1954 Carr
2,679,117 A 5/1954 Reed
2,701,887 A 2/1955 Nolan
2,936,670 A 5/1960 Walter
3,052,904 A 9/1962 Reid et al.
3,081,368 A 3/1963 Wunsche
3,257,677 A 6/1966 Batchelder et al.
3,282,757 A 11/1966 Brussee
3,397,847 A 8/1968 Thaden
3,474,478 A 10/1969 Rubico et al.
3,504,450 A 4/1970 Steadman et al.
3,525,110 A 8/1970 Rubico et al.
3,586,058 A 6/1971 Ahrens et al.
3,619,838 A 11/1971 Winkler
3,714,862 A 2/1973 Berger
3,745,600 A 7/1973 Rubico et al.
3,805,667 A 4/1974 Orser
3,821,827 A 7/1974 Nadler
3,866,512 A 2/1975 Berger
4,134,955 A 1/1979 Hanrahan, Jr. et al.
4,149,249 A 4/1979 Pavkovich
4,194,249 A * 3/1980 Thorneburg ..... D04B 1/02 2/239
4,222,183 A 9/1980 Haddox
4,232,458 A 11/1980 Bartels
4,275,638 A 6/1981 DeYoung
4,341,097 A * 7/1982 Cassidy, Sr. ..... D04B 1/108 66/187
4,351,889 A 9/1982 Sundberg
4,394,803 A 7/1983 Goldstein
4,430,811 A 2/1984 Okada
4,447,967 A 5/1984 Zaino
4,519,290 A 5/1985 Inman et al.
4,587,749 A 5/1986 Berlese
4,591,155 A 5/1986 Yutaka
4,629,650 A 12/1986 Kataoka
4,640,027 A 2/1987 Berlese
4,662,088 A 5/1987 Autry et al.
4,719,837 A 1/1988 McConnell et al.
4,785,558 A 11/1988 Shiomura
4,800,796 A 1/1989 Vendramini
4,847,063 A 7/1989 Smith
4,848,745 A 7/1989 Bohannan et al.
4,857,124 A 8/1989 Shobert et al.
4,879,778 A 11/1989 Becka et al.
4,882,858 A 11/1989 Signori
4,885,973 A 12/1989 Spain
4,916,997 A 4/1990 Spain
4,919,388 A 4/1990 Koike et al.
4,939,805 A 7/1990 Walega
4,974,275 A 12/1990 Backes et al.
4,976,812 A 12/1990 McConnell et al.
4,992,313 A 2/1991 Shobert et al.
5,001,961 A 3/1991 Spain
D315,823 S 4/1991 Signori
5,067,525 A 11/1991 Tsuzuki et al.
5,121,329 A 6/1992 Crump
5,201,952 A 4/1993 Yahagi et al.
5,203,249 A 4/1993 Adams et al.
5,257,571 A 11/1993 Richardson
5,287,790 A 2/1994 Akiyama et al.
5,335,517 A * 8/1994 Throneburg ..... A41B 11/00 2/239
5,344,315 A 9/1994 Hanson
5,345,638 A 9/1994 Nishida
5,348,056 A 9/1994 Tsuzuki
5,361,674 A 11/1994 Akiyama et al.
5,381,610 A 1/1995 Hanson
5,385,077 A 1/1995 Akiyama et al.
5,388,497 A 2/1995 Akiyama et al.
5,396,829 A 3/1995 Akiyama et al.
5,398,586 A 3/1995 Akiyama et al.
5,439,215 A 8/1995 Ratchford
5,476,027 A 12/1995 Uchida et al.
5,647,150 A 7/1997 Romanato et al.
5,732,413 A 3/1998 Williams
5,792,093 A * 8/1998 Tanaka ..... A61H 39/04 602/30
5,885,622 A 3/1999 Daley
5,896,758 A 4/1999 Rock et al.
5,901,632 A 5/1999 Ryan
6,024,005 A 2/2000 Uozumi
6,029,376 A 2/2000 Cass

(56) References Cited

U.S. PATENT DOCUMENTS 6,205,683 B1 3/2001 Clark et al.
6,298,582 B1 10/2001 Friton et al.
6,308,536 B2 * 10/2001 Roell ..... D04B 1/22 66/64
6,345,598 B1 2/2002 Bogdanovich et al.
6,401,364 B1 6/2002 Burt
6,451,046 B1 9/2002 Leo et al.
6,482,492 B1 11/2002 Hung
6,510,961 B1 1/2003 Head et al.
6,588,237 B2 7/2003 Cole et al.
6,679,152 B1 1/2004 Head et al.
6,696,001 B1 2/2004 Quddus
6,826,853 B1 12/2004 Zanatta
6,910,288 B2 6/2005 Dua
6,931,762 B1 8/2005 Dua
6,945,153 B2 9/2005 Knudsen et al.
6,971,252 B2 * 12/2005 Therin ..... A61F 2/0045 66/170
7,004,967 B2 2/2006 Chouinard et al.
7,047,668 B2 5/2006 Burris et al.
7,093,527 B2 8/2006 Rapaport et al.
7,168,951 B2 1/2007 Fischer et al.
7,204,903 B2 4/2007 Yasui
7,228,777 B2 6/2007 Morissette et al.
7,252,028 B2 8/2007 Bechtold et al.
7,262,353 B2 8/2007 Bartholomew et al.
7,275,471 B2 10/2007 Nishr et al.
7,293,371 B2 * 11/2007 Aveni ..... A43B 7/08 36/45
7,300,014 B2 11/2007 Allen
7,347,011 B2 3/2008 Dua et al.
D578,294 S 10/2008 Mervar et al.
7,430,818 B2 10/2008 Valat et al.
7,444,916 B2 11/2008 Hirukawa
7,549,185 B2 6/2009 Yang
7,566,376 B2 7/2009 Matsuoka
7,703,218 B2 4/2010 Burgess
7,703,220 B2 4/2010 Aveni
7,793,434 B2 9/2010 Sokolowski et al.
7,793,576 B2 9/2010 Head et al.
7,815,141 B2 10/2010 Uozumi et al.
7,836,608 B2 11/2010 Greene
7,870,681 B2 1/2011 Meschter
7,908,956 B2 3/2011 Dow et al.
7,913,426 B2 3/2011 Valat et al.
7,938,853 B2 5/2011 Chouinard et al.
7,941,942 B2 5/2011 Hooper et al.
7,963,747 B2 6/2011 Cairo
8,006,601 B2 8/2011 Inazawa et al.
8,051,585 B2 11/2011 Hope et al.
8,056,173 B2 11/2011 RongBo
8,061,253 B2 11/2011 Wybrow
8,210,086 B2 7/2012 Head et al.
8,261,648 B1 9/2012 Marchand et al.
8,266,827 B2 9/2012 Dojan et al.
8,312,645 B2 11/2012 Dojan et al.
8,312,646 B2 11/2012 Meschter et al.
8,388,791 B2 3/2013 Dojan et al.
8,394,222 B2 3/2013 Rettig
8,438,757 B2 5/2013 Roser
8,511,214 B2 8/2013 Gries
8,544,197 B2 10/2013 Spanks et al.
8,544,199 B1 10/2013 Pentland
8,578,534 B2 11/2013 Langvin et al.
8,578,632 B2 11/2013 Bell et al.
8,651,007 B2 2/2014 Adams
8,690,962 B2 4/2014 Dignam et al.
8,757,038 B2 6/2014 Siegismund
8,770,081 B2 7/2014 David et al.
8,789,295 B2 7/2014 Burch et al.
8,789,452 B1 7/2014 Janardhan et al.
8,794,118 B2 8/2014 Dow et al.
8,819,963 B2 9/2014 Dojan et al.
8,959,959 B1 2/2015 Podhajny
8,984,776 B2 3/2015 Ludemann et al.
8,997,529 B1 4/2015 Podhajny
D737,561 S 9/2015 Aveni et al.
9,179,739 B2 11/2015 Bell et al.
D769,590 S 10/2016 Aveni et al.
9,668,544 B2 6/2017 Bruce et al.
9,681,708 B2 6/2017 Greene et al.
9,723,895 B2 * 8/2017 Schaefer ..... A43B 23/026
9,756,901 B2 9/2017 Musho et al.
D798,565 S 10/2017 Aveni et al.
9,839,253 B2 12/2017 Bruce et al.
10,159,297 B2 12/2018 Jamison
10,238,176 B2 3/2019 Bruce et al.
10,280,538 B2 5/2019 Bruce et al.
10,299,544 B2 5/2019 Bruce et al.
10,631,594 B2 4/2020 Boucher et al.
10,709,204 B2 * 7/2020 Iuchi ..... A43B 23/0205
10,952,490 B2 3/2021 Bruce et al.
2001/0007180 A1 7/2001 Bordin et al.
2003/0000111 A1 1/2003 Basso
2003/0213547 A1 11/2003 Ono et al.
2004/0118018 A1 6/2004 Dua
2004/0244412 A1 12/2004 Trinh et al.
2005/0076536 A1 4/2005 Hatfield et al.
2005/0081402 A1 * 4/2005 Orei ..... A43B 7/06 36/45
2005/0115284 A1 * 6/2005 Dua ..... A43B 23/042 66/178 R
2005/0178026 A1 * 8/2005 Friton ..... A43B 1/04 36/50.1
2005/0193592 A1 * 9/2005 Dua ..... A43B 23/042 36/45
2005/0208860 A1 * 9/2005 Baron ..... A43B 1/14 442/414
2005/0284002 A1 * 12/2005 Aveni ..... A43B 1/04 36/50.1
2006/0048413 A1 3/2006 Sokolowski et al.
2006/0059715 A1 3/2006 Aveni
2006/0162190 A1 * 7/2006 Nishiwaki ..... A43B 23/047 36/97
2006/0247566 A1 * 11/2006 Gobet ..... A61F 13/08 602/62
2006/0260365 A1 * 11/2006 Miyamoto ..... D04B 15/36 66/7
2006/0265908 A1 11/2006 Palmer et al.
2006/0283042 A1 12/2006 Greene et al.
2006/0283048 A1 12/2006 Lebo
2007/0022627 A1 * 2/2007 Sokolowski ..... A43B 23/0255 36/3 A
2007/0062067 A1 3/2007 Covatch
2007/0101615 A1 5/2007 Munns
2007/0101616 A1 5/2007 Munns
2007/0180730 A1 * 8/2007 Greene ..... A43B 23/0295 36/3 A
2007/0245595 A1 10/2007 Chen et al.
2007/0271821 A1 11/2007 Meschter
2007/0271822 A1 11/2007 Meschter
2008/0005930 A1 1/2008 Skirrow
2008/0022553 A1 1/2008 McDonald et al.
2008/0078103 A1 4/2008 Liles
2008/0110048 A1 5/2008 Dua et al.
2008/0110049 A1 5/2008 Sokolowski et al.
2008/0250668 A1 * 10/2008 Marvin ..... A43B 23/0205 36/54
2009/0126081 A1 * 5/2009 Lambertz ..... A41B 11/003 2/239
2009/0126225 A1 5/2009 Jarvis
2009/0126823 A1 5/2009 Yengkhom
2009/0193961 A1 8/2009 Jensen et al.
2009/0241374 A1 10/2009 Sato et al.
2009/0306762 A1 12/2009 McCullagh et al.
2010/0018075 A1 1/2010 Meschter et al.
2010/0043253 A1 2/2010 Dojan et al.
2010/0095556 A1 4/2010 Jarvis
2010/0107442 A1 5/2010 Hope et al.
2010/0139057 A1 6/2010 Soderberg et al.
2010/0154256 A1 * 6/2010 Dua ..... A43B 1/04 36/25 R
2010/0175276 A1 7/2010 Dojan et al.

(56) References Cited

U.S. PATENT DOCUMENTS

2010/0199520 A1 8/2010 Dua et al.
2010/0251491 A1 10/2010 Dojan et al.
2010/0251564 A1 10/2010 Meschter
2010/0319215 A1 12/2010 Roser
2011/0041359 A1 2/2011 Dojan et al.
2011/0067271 A1 3/2011 Foxen et al.
2011/0078921 A1* 4/2011 Greene ..... A43B 1/04 36/47
2011/0088285 A1 4/2011 Dojan et al.
2011/0094127 A1 4/2011 Dana, III
2011/0146104 A1 6/2011 Lafortune
2011/0239486 A1 10/2011 Berger et al.
2011/0266384 A1 11/2011 Goodman et al.
2012/0011744 A1 1/2012 Bell et al.
2012/0023786 A1 2/2012 Dojan
2012/0030965 A1 2/2012 Greene et al.
2012/0055044 A1 3/2012 Dojan et al.
2012/0066931 A1 3/2012 Dojan et al.
2012/0096742 A1 4/2012 Shim
2012/0100778 A1* 4/2012 Cho ..... A41D 1/06 450/95
2012/0117826 A1 5/2012 Jarvis
2012/0144698 A1 6/2012 McDowell
2012/0159813 A1 6/2012 Dua et al.
2012/0180195 A1* 7/2012 Shull ..... D04B 1/18 2/239
2012/0186102 A1 7/2012 Lee et al.
2012/0198730 A1 8/2012 Burch et al.
2012/0233882 A1 9/2012 Huffa et al.
2012/0234052 A1 9/2012 Huffa et al.
2012/0240429 A1 9/2012 Sokolowski et al.
2012/0246973 A1 10/2012 Dua
2012/0255201 A1* 10/2012 Little ..... A43D 999/00 36/84
2012/0279260 A1 11/2012 Dua et al.
2012/0291314 A1 11/2012 Sokolowski et al.
2012/0297643 A1 11/2012 Shaffer et al.
2013/0019500 A1 1/2013 Greene
2013/0025157 A1 1/2013 Wan et al.
2013/0055590 A1 3/2013 Mokos
2013/0081307 A1 4/2013 del Biondi et al.
2013/0152424 A1 6/2013 Dojan
2013/0174446 A1 7/2013 Antonelli et al.
2013/0211492 A1 8/2013 Schneider
2013/0219636 A1 8/2013 Dojan et al.
2013/0239438 A1 9/2013 Dua et al.
2013/0255103 A1 10/2013 Dua et al.
2013/0260104 A1 10/2013 Dua et al.
2013/0260629 A1 10/2013 Dua et al.
2013/0269159 A1 10/2013 Robitaille et al.
2013/0269209 A1 10/2013 Lang et al.
2013/0269212 A1 10/2013 Little
2013/0291293 A1 11/2013 Jessiman et al.
2013/0304232 A1 11/2013 Gries
2013/0305465 A1* 11/2013 Siegismund ..... D04C 1/06 12/146 C
2013/0305911 A1 11/2013 Masson et al.
2013/0312284 A1 11/2013 Berend et al.
2014/0000043 A1 1/2014 Boardman et al.
2014/0007458 A1 1/2014 Berger et al.
2014/0020191 A1 1/2014 Jones et al.
2014/0020192 A1 1/2014 Jones et al.
2014/0068838 A1 3/2014 Beers et al.
2014/0070042 A1 3/2014 Beers et al.
2014/0082905 A1 3/2014 Wen
2014/0088688 A1 3/2014 Lilburn et al.
2014/0109441 A1 4/2014 McDowell et al.
2014/0130372 A1 5/2014 Aveni et al.
2014/0134405 A1 5/2014 Yang
2014/0137433 A1 5/2014 Craig
2014/0137434 A1 5/2014 Craig
2014/0150292 A1 6/2014 Podhajny et al.
2014/0173932 A1 6/2014 Bell
2014/0173934 A1* 6/2014 Bell ..... D03D 13/002 36/84
2014/0173935 A1 6/2014 Sabbioni
2014/0182447 A1 7/2014 Kang et al.
2014/0189964 A1* 7/2014 Wen ..... A43B 23/027 12/142 R
2014/0196316 A1 7/2014 Follet
2014/0215850 A1* 8/2014 Redl ..... A43B 23/0235 36/47
2014/0237854 A1 8/2014 Fallon
2014/0237858 A1* 8/2014 Adami ..... A43B 23/0255 36/107
2014/0245633 A1 9/2014 Podhajny
2014/0259760 A1 9/2014 Dojan et al.
2014/0310983 A1 10/2014 Tamm et al.
2014/0310984 A1* 10/2014 Tamm ..... A43B 23/027 36/84
2014/0310986 A1 10/2014 Tamm et al.
2014/0310987 A1 10/2014 Sokolowski et al.
2014/0338222 A1 11/2014 Song
2014/0352173 A1 12/2014 Bell et al.
2014/0373389 A1 12/2014 Bruce
2014/0377488 A1 12/2014 Jamison
2015/0007451 A1 1/2015 Bruce
2015/0013187 A1* 1/2015 Taniguchi ..... A43B 23/0255 36/84
2015/0052778 A1 2/2015 Kirk et al.
2015/0075031 A1 3/2015 Podhajny et al.
2015/0143716 A1 5/2015 Long et al.
2015/0143720 A1 5/2015 Avar
2015/0201705 A1 7/2015 Doremus et al.
2015/0201707 A1 7/2015 Bruce
2015/0202915 A1 7/2015 Lee
2015/0272274 A1 10/2015 Berns et al.
2015/0282564 A1 10/2015 Meschter et al.
2015/0282565 A1 10/2015 Kilgore
2015/0305442 A1 10/2015 Ravindran
2015/0313316 A1 11/2015 Boucher et al.
2015/0320139 A1* 11/2015 Peitzker ..... A43C 15/18 36/11.5
2015/0342286 A1 12/2015 Huffman et al.
2015/0374064 A1 12/2015 Pierobon
2016/0021979 A1 1/2016 Iuchi et al.
2016/0029736 A1 2/2016 Meir
2016/0058100 A1 3/2016 Dealey et al.
2016/0076178 A1 3/2016 Head et al.
2016/0088899 A1 3/2016 Liles et al.
2016/0095377 A1 4/2016 Tamm
2016/0106182 A1 4/2016 Yun
2016/0166000 A1 6/2016 Bruce et al.
2016/0166007 A1 6/2016 Bruce et al.
2016/0166010 A1 6/2016 Bruce et al.
2016/0168774 A1 6/2016 Breithaupt et al.
2016/0174660 A1 6/2016 Iuchi et al.
2016/0185062 A1 6/2016 Boucher et al.
2016/0206044 A1 7/2016 Dimoff et al.
2016/0208421 A1 7/2016 Baines et al.
2016/0213095 A1 7/2016 Kohatsu et al.
2016/0286898 A1 10/2016 Manz et al.
2016/0345675 A1 12/2016 Bruce et al.
2016/0345676 A1 12/2016 Bruce et al.
2016/0345677 A1 12/2016 Bruce et al.
2017/0020231 A1 1/2017 Hausmann et al.
2017/0035149 A1 2/2017 Bruce et al.
2017/0138513 A1 5/2017 Andresen et al.
2017/0265596 A1 9/2017 Bruce et al.
2017/0325545 A1 11/2017 Becker et al.
2017/0325546 A1 11/2017 Becker et al.
2017/0347754 A1 12/2017 Fuerst, Jr. et al.
2018/0020762 A1 1/2018 Jamison
2018/0242689 A1 8/2018 Bruce et al.
2018/0343959 A1 12/2018 Bruce et al.
2018/0343961 A1 12/2018 Bruce et al.
2018/0343962 A1 12/2018 Bruce et al.
2018/0343963 A1 12/2018 Bruce et al.
2018/0368506 A1 12/2018 Bruce et al.
2019/0008235 A1 1/2019 Wu
2019/0014854 A1 1/2019 Santos et al.
2019/0150552 A1 5/2019 Casillas et al.

(56) References Cited

U.S. PATENT DOCUMENTS

| | | | |
|---|---|---|---|
| 2019/0231031 | A1 | 8/2019 | Bruce et al. |
| 2019/0254386 | A1 | 8/2019 | Bruce et al. |
| 2020/0146390 | A1 | 5/2020 | Heidenfelder et al. |

FOREIGN PATENT DOCUMENTS

| | | | | |
|---|---|---|---|---|
| CN | 1121403 | A | 5/1996 | |
| CN | 1883325 | A | 12/2006 | |
| CN | 2930360 | Y | 8/2007 | |
| CN | 201175007 | Y | 1/2009 | |
| CN | 101426390 | A | 5/2009 | |
| CN | 201356120 | Y | 12/2009 | |
| CN | 101627843 | A | 1/2010 | |
| CN | 101801229 | A | 8/2010 | |
| CN | 202536202 | U | 11/2012 | |
| CN | 202635759 | U | 1/2013 | |
| CN | 102987631 | A | 3/2013 | |
| CN | 202950101 | U | 5/2013 | |
| CN | 103415657 | A | 11/2013 | |
| CN | 203369442 | U | 1/2014 | |
| CN | 103653542 | A | 3/2014 | |
| CN | 203676256 | U | 7/2014 | |
| CN | 104185431 | A | 12/2014 | |
| CN | 204526335 | U | 8/2015 | |
| CN | 105246362 | A | 1/2016 | |
| CN | 205831190 | U | 12/2016 | |
| DE | 726634 | C | 10/1942 | |
| DE | 1140107 | B | 11/1962 | |
| DE | 4306286 | A1 | 9/1993 | |
| DE | 19809085 | A1 | 8/1999 | |
| DE | 102011011185 | A1 | 8/2012 | |
| DE | 102011119245 | A1 | 10/2012 | |
| DE | 102012020216 | A1 | 4/2014 | |
| EP | 372370 | A2 | 6/1990 | |
| EP | 1486601 | A1 | 12/2004 | |
| EP | 2792261 | A1 | 10/2014 | |
| EP | 2792264 | A2 | 10/2014 | |
| EP | 2811056 | A1 | 12/2014 | |
| FR | 1012719 | A | 7/1952 | |
| GB | 430805 | A | 6/1935 | |
| GB | 477556 | A | 1/1938 | |
| GB | 477556 | A * | 1/1938 | ..... A43B 23/0205 |
| GB | 1083849 | A | 9/1967 | |
| GB | 1299353 | | 12/1972 | |
| JP | S51107964 | U1 | 8/1976 | |
| JP | 07054250 | A | 2/1995 | |
| JP | 07033076 | B2 | 4/1995 | |
| JP | 07216703 | A | 8/1995 | |
| JP | 08109553 | A | 4/1996 | |
| JP | 09322810 | A | 12/1997 | |
| JP | 10158965 | A | 6/1998 | |
| JP | 2001030361 | A | 2/2001 | |
| JP | 2004105323 | A | 4/2004 | |
| JP | 2004339651 | A | 12/2004 | |
| JP | 2005042266 | A | 2/2005 | |
| JP | 2005060885 | A | 3/2005 | |
| JP | 2005102933 | A | 4/2005 | |
| JP | 2005-160697 | A | 6/2005 | |
| JP | 2005290628 | A | 10/2005 | |
| JP | 2006009175 | A | 1/2006 | |
| JP | 2006161167 | A | 6/2006 | |
| JP | 2008240187 | A | 10/2008 | |
| JP | 6527230 | B2 | 5/2019 | |
| KR | 20020038168 | A | 5/2002 | |
| KR | 100737426 | B1 | 7/2007 | |
| TW | 201105521 | A | 2/2011 | |
| WO | 98/24616 | A1 | 6/1998 | |
| WO | 0007475 | A1 | 2/2000 | |
| WO | 0036943 | A1 | 6/2000 | |
| WO | 03016036 | A2 | 2/2003 | |
| WO | 2009000371 | A1 | 12/2008 | |
| WO | 2010/100488 | A1 | 9/2010 | |
| WO | 2011111564 | A1 | 9/2011 | |
| WO | 2011126837 | A2 | 10/2011 | |
| WO | 2011137405 | A2 | 11/2011 | |
| WO | 2013071679 | A1 | 5/2013 | |
| WO | 2013126313 | A2 | 8/2013 | |
| WO | 2014134244 | A1 | 9/2014 | |
| WO | 2014209594 | A1 | 12/2014 | |
| WO | 2014209596 | A1 | 12/2014 | |
| WO | 2016093961 | A1 | 6/2016 | |
| WO | 2016191478 | A1 | 12/2016 | |

OTHER PUBLICATIONS

Extended Search Report dated Aug. 16, 2019 in European Patent Application No. 18202740.9, 11 pages.
Non-Final Office Action dated Aug. 19, 2019 in U.S. Appl. No. 14/163,438, 15 pages.
Non-Final Office Action dated Aug. 21, 2009 in U.S. Appl. No. 14/566,215, 21 pages.
Notice of Allowance dated Sep. 16, 2019 in U.S. Appl. No. 14/721,450, 9 pages.
Final Office Action received for U.S. Appl. No. 14/820,822, dated Jun. 9, 2020, 18 pages.
Final Office Action received for U.S. Appl. No. 15/993,180, dated Jun. 12, 2020, 15 pages.
Non-Final Office Action received for U.S. Appl. No. 14/163,438, dated Jun. 25, 2020, 14 pages.
Non-Final Office Action received for U.S. Appl. No. 16/192,129, dated Jun. 12, 2020, 10 pages.
Notice of Allowance received for U.S. Appl. No. 15/993,195, dated Jun. 5, 2020, 5 pages.
Office Action received for Canadian Patent Application No. 3020031, dated Jun. 5, 2020, 5 pages.
Office Action received for Indian Patent Application No. 201747019912, dated Jun. 16, 2020, 5 pages.
Office Action received for Indian Patent Application No. 201747019980, dated Jun. 16, 2020, 5 pages.
Non-Final Office Action received for U.S. Appl. No. 15/993,180, dated Apr. 6, 2020, 13 pages.
Office Action received for European Patent Application No. 16727106.3, dated Apr. 8, 2020, 6 pages.
Intention to Grant received for European Patent Application No. 16001887.5, dated Jul. 28, 2020, 8 pages.
Non-Final Office Action received for U.S. Appl. No. 16/404,286, dated Jul. 22, 2020, 5 pages.
Notice of Allowance received for U.S. Appl. No. 14/566,215, dated Aug. 12, 2020, 13 pages.
Office Action received for European Patent Application No. 15787425.6, dated Aug. 5, 2020, 6 pages.
Communication under Rule 71(3) dated Feb. 20, 2019 in European Patent Application No. 15785032.2, 5 pages.
Communication under Rule 71(3) dated Mar. 13, 2019 in European Patent Application No. 15787396.9, 5 pages.
Final Office Action received for U.S. Appl. No. 14/163,438, dated Jan. 13, 2020, 12 pages.
International Preliminary Report on Patentability received for PCT Patent Application No. PCT/US2018/035404, dated Dec. 12, 2019, 8 pages.
Office Action received for European Patent Application No. 15787425.6, dated Jan. 23, 2020, 6 pages.
Summons to Attend Oral Proceedings received for European Patent Application No. 16001887.5, mailed on Dec. 2, 2019, 5 pages.
Final Office Action received for U.S. Appl. No. 14/566,215, dated Jan. 30, 2020, 26 pages.
Extended Search Report dated Nov. 29, 2019 in European Patent Application No. 19192467.9, 5 pages.
Partial search report dated Dec. 9, 2019 in European Patent Application No. 19191026.4, 15 pages.
International Preliminary Report on Patentability dated Dec. 12, 2019 in International Patent Application No. PCT/US2018/035417, 8 pages.
International Preliminary Report on Patentability dated Dec. 12, 2019 in International Patent Application No. PCT/US2018/035408, 10 pages.
Final Office Action dated Apr. 25, 2019 in U.S. Appl. No. 14/820,822, 15 pages.

(56) References Cited

OTHER PUBLICATIONS

Partial search report dated Apr. 26, 2019 in European Patent Application No. 18202740.9, 13 pages.
Final Office Action dated May 1, 2019 in U.S. Appl. No. 14/721,450, 6 pages.
Communication pursuant to Article 94(3) dated May 13, 2019 in European Patent Application No. 16001887.5, 4 pages.
Communication under Rule 71(3) dated May 16, 2019 in European Patent Application No. 16731401.2, 5 pages.
Communication under Rule 71(3) dated Jun. 21, 2019 in European Patent Application No. 15785032.2, 2 pages.
Non-Final Office Action dated Jul. 9, 2019 in U.S. Appl. No. 14/721,450, 6 pages.
Extended European Search Report received for European Patent Application No. 19191026.4, dated Mar. 12, 2020, 12 pages.
Notice of Allowance received for U.S. Appl. No. 14/565,598, dated Mar. 16, 2020, 8 pages.
International Preliminary Report on Patentability received for PCT Patent Application No. PCT/US2018/061502, dated Jun. 4, 2020, 10 pages.
Non-Final Office Action received for U.S. Appl. No. 15/940,234, dated May 29, 2020, 12 pages.
Branscomb et al., "New Directions in Braiding", Journal of Engineered Fibers and Fabrics, vol. 8, Issue 2-2013Braiding, Journal of Engineered Fibers and Fabrics, vol. 8, Issue Feb. 2013—http://www.jeffournal.org, pp. 11-24.
Final Office Action dated Dec. 14, 2018 in U.S. Appl. No. 14/565,598, 22 pages.
Non-Final Office Action dated Dec. 28, 2018 in U.S. Appl. No. 14/721,450, 6 pages.
Notice of Allowance dated Jan. 11, 2019 in U.S. Appl. No. 15/613,983, 7 pages.
Braiding Definition for the Clothing Industry, Accessed Jan. 24, 2017 http://www.apparelsearch.com/definitions/miscellaneous/braiding.htm.
Non-Final Office Action received for U.S. Appl. No. 15/993,190, dated May 7, 2020, 11 pages.
Notice of Allowance received for U.S. Appl. No. 15/903,542, dated May 8, 2020, 9 pages.
International Search Report and Written Opinion received for PCT Patent Application No. PCT/US2019/036495, dated Nov. 8, 2019, 20 pages.
Non-Final Office Action received for U.S. Appl. No. 15/993,195, dated Feb. 6, 2020, 16 pages.
Non-Final Office Action dated Oct. 29, 2019 in U.S. Appl. No. 14/820,822, 15 pages.
Non-Final Office Action dated Nov. 1, 2019 in U.S. Appl. No. 14/565,598, 18 pages.
Intention to Grant received for European Patent Application No. 16727106.3, dated Nov. 20, 2020, 8 pages.
Notice of Allowance received for U.S. Appl. No. 16/404,286, dated Nov. 25, 2020, 5 pages.
Non-Final Office Action received for U.S. Appl. No. 15/993,180, dated Dec. 11, 2020, 14 pages.
Office Action received for Canadian Patent Application No. 3020031, dated Nov. 24, 2020, 5 pages.
Final Office Action received for U.S. Appl. No. 15/940,234, dated Oct. 19, 2020, 10 pages.
Final Office Action received for U.S. Appl. No. 15/993,190, dated Oct. 14, 2020, 13 pages.
Final Office Action received for U.S. Appl. No. 16/192,129, datead Oct. 30, 2020, 10 pages.
Intention to Grant received for European Patent Application No. 19192467.9, dated Oct. 6, 2020, 8 pages.
Office Action received for Indian Patent Application No. 201747020263, dated Sep. 18, 2020, 7 pages.
Office Action received for Sri Lankan Patent Application No. 20033, dated Aug. 14, 2020, 1 page.
Non-Final Office Action received for U.S. Appl. No. 14/820,822, dated Jan. 29, 2021, 16 pages.
Office Action received for European Patent Application No. 19191026.4, dated Jul. 13, 2021, 5 pages.
Intention to Grant received for European Patent Application No. 15787425.6, dated Apr. 28, 2021, 4 pages.
Notice of Allowance received for U.S. Appl. No. 15/993,180, dated Apr. 1, 2021, 11 pages.
Office Action received for European Patent Application No. 18202740.9, dated Mar. 26, 2021, 4 pages.
Office Action received for European Patent Application No. 16751107.0, dated May 25, 2021, 7 pages.
Non-Final Office action received for U.S. Appl. No. 15/993,190, dated Jun. 11, 2021, 11 pages.
Notice of Allowance received for U.S. Appl. No. 14/820,822, dated Jun. 8, 2021, 9 pages.

* cited by examiner

ARTICLE OF FOOTWEAR WITH BRAIDED UPPER

CROSS-REFERENCE TO RELATED APPLICATIONS

This application entitled "Article of Footwear with Braided Upper" is a continuation of U.S. application Ser. No. 14/495,252, filed Sep. 24, 2014, which is a continuation of U.S. patent application Ser. No. 14/163,392, filed Jan. 24, 2014, now abandoned, which claims priority to U.S. Provisional Patent Application No. 61/839,097, filed Jun. 25, 2013, the entireties of each application being herein incorporated by reference. This application is also related to U.S. patent application Ser. No. 14/163,438, filed Jan. 24, 2014, and titled "Braided Upper with Overlays for Article of Footwear", the entirety of which is herein incorporated by reference.

BACKGROUND

The present embodiments relate generally to articles of footwear, and in particular to articles of footwear with a braided upper.

Typical athletic shoes have two major components, an upper that provides the enclosure for receiving the foot, and a sole secured to the upper. The upper may be adjustable using laces, hook-and-loop fasteners or other devices to secure the shoe properly to the foot. The sole has the primary contact with the playing surface. The sole may be designed to absorb the shock as the shoe contacts the ground or other surfaces. The upper may be designed to provide the appropriate type of protection to the foot and to maximize the wearer's comfort.

BRIEF SUMMARY

In one aspect, embodiments of the article of footwear have a sole and an upper attached to the sole. The upper has a braided structure that has a first region with a first density of braids and at least a second region with a different density of braids. The first density of braids is lower than the second density of braids. The high density braids may be used in regions of the footwear that require more stability, more durability and/or more strength.

In another aspect, an embodiment is an article of footwear with a sole and an upper. The upper has a braided structure and is attached to the sole. The upper has a higher braid density around the perimeter of its throat and around the perimeter of its ankle opening.

In yet another aspect, embodiments of the article of footwear have an upper formed from a braided structure attached to the sole. The braided structure has a first high density band attached at the lateral side of the footwear to the sole at the forefoot region and attached at the medial side of the footwear to the sole at the midfoot region. The braided structure has a second high density band attached at the lateral side to the sole at the midfoot region and at the medial side to the sole at the forefoot region. The two bands intersect at the apex of the midfoot region.

In yet another aspect, embodiments of the article of footwear is made of a braided structure forming an upper for the footwear and a sole attached to the upper. Floating cables are laced through a portion of the braided structure of the upper in different regions of the upper. The floating cables may be attached at one end to eyelets of the upper, and at their other end to the sole.

In yet another aspect, embodiments of the article of footwear include a sole bearing ground-engaging components and an upper attached to the sole. The upper has a throat, a heel region, a midfoot region and a forefoot region. It has a low density braid at the midfoot region and a high density braid at the heel region. It also has a high density braid around the throat and another band of high density braid in front of the throat of the upper. The upper has an integrated lateral side lace laced through the band of high density braid on a lateral side of the article of footwear to a lateral side eyelet, and an integrated medial side lace laced through the band of high density braid on the medial side of the article of footwear to a medial side eyelet.

In yet another aspect, an upper for an article of footwear has a heel region, a midfoot region, and a forefoot region. The upper has eyelets disposed on either side of a throat. The upper has a braided structure with bands of high density braids at the heel region and at the midfoot region, and bands of low density braids at the forefoot region and in the toe region. It also has a lateral side lace attached at the lateral side of the upper to a bottom of the lateral side of the upper; and a medial side lace attached at a medial side of the upper to a bottom of the medial side of the upper. The laces are then laced through the braided structure and through at least one eyelet on the lateral side of the upper and at least one eyelet on the medial side of the upper.

In yet another aspect, a method of manufacture of braided uppers uses overlast braiding to manufacture the braided uppers. A last with pins demarcating various bands having higher or lower braiding densities may be fed through a braiding apparatus one, twice or several times to produce the desired braided structure.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF SEVERAL VIEWS OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Embodiments of the article of footwear with a braided upper include braided uppers that have engineered regions adapted to a wearer's foot. The braided upper may be attached to a sole using stitching, stapling, fusing, adhesives or any other attachment method. Articles of footwear having different performance and/or comfort characteristics may be engineered by varying, for example, the braid angle, the braid pitch, the braid coverage and/or other parameters. The braided upper may also have different materials having different mechanical or other properties in different parts of the upper to provide specific characteristics to specific regions of the upper.

Braided fabrics can be formed by intertwining three or more strands of yarn, filaments or other fibers to form the fabric. In the example shown in FIG. 1, strands 11 are intertwined forming a fabric 10 with an open structure.

Figure 2:
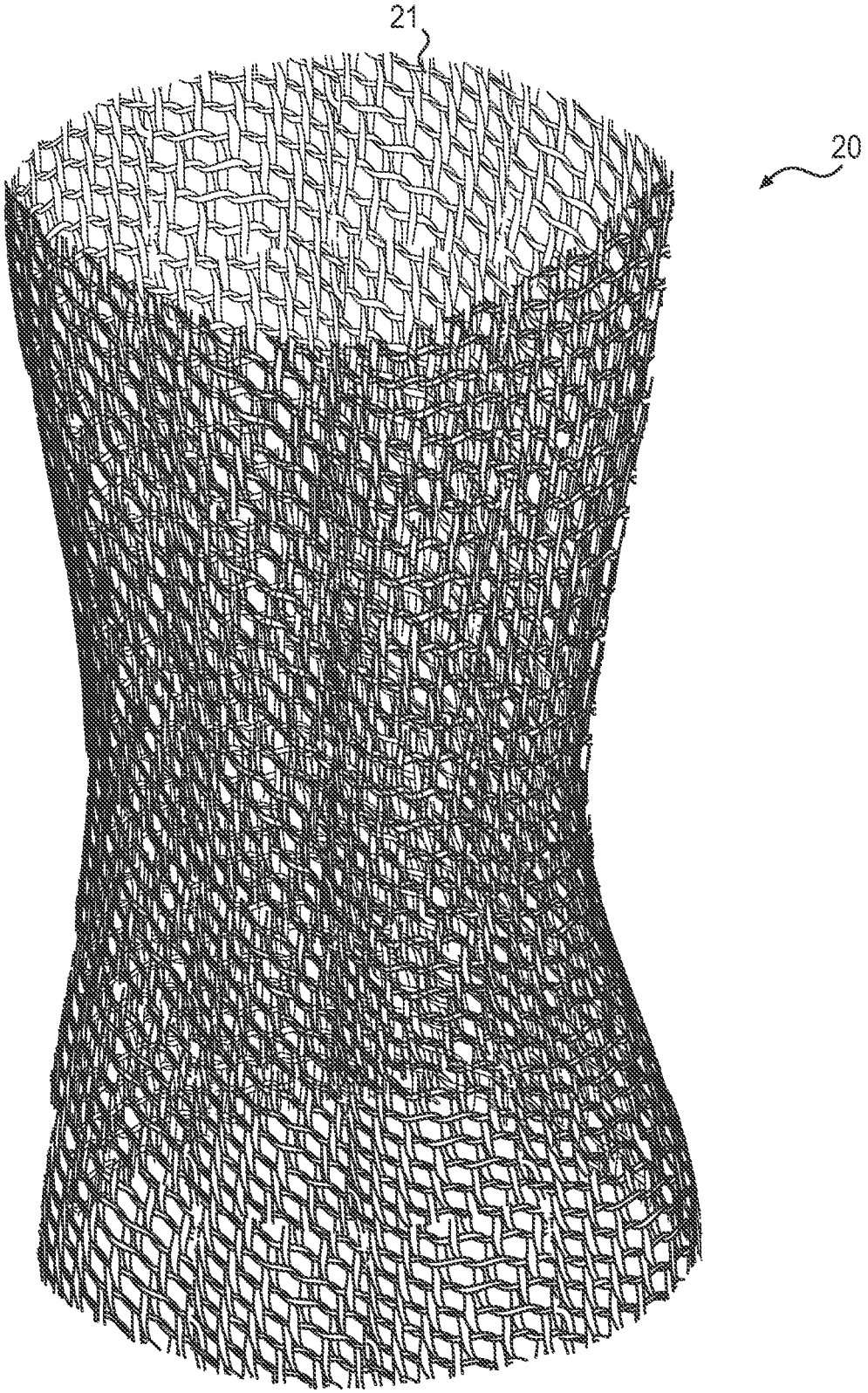
FIG. 2 is a schematic representation of a three-dimensional braided structure.

Braiding can be used to form three-dimensional structures, as in the example shown in FIG. 2, by braiding strands of yarn over a form or a last. Strands 21 can be fabricated from fibers such as nylon, carbon, polyurethane, polyester, cotton, aramid (e.g., Kevlar®), polyethylene or polypropylene. These strands can be braided to form three-dimensional structures for a wide variety of applications. For example, braided three-dimensional structures may be used to manufacture products as varied as bicycle helmets, aircraft fuselage components and rocket nozzles.

Braided structures may be fabricated manually, or may be manufactured using automated braiding machinery, such as the machinery disclosed in U.S. Pat. Nos. 7,252,028; 8,261,648; 5,361,674; 5,398,586; and 4,275,638, all of which are incorporated by reference in their entirety herein. Such three-dimensional braided structures may also be manufactured to a specific design by, for example, TEF Braids, Warrensburg, N.Y. or A&P Technology, Cincinnati, Ohio.

Figure 3:
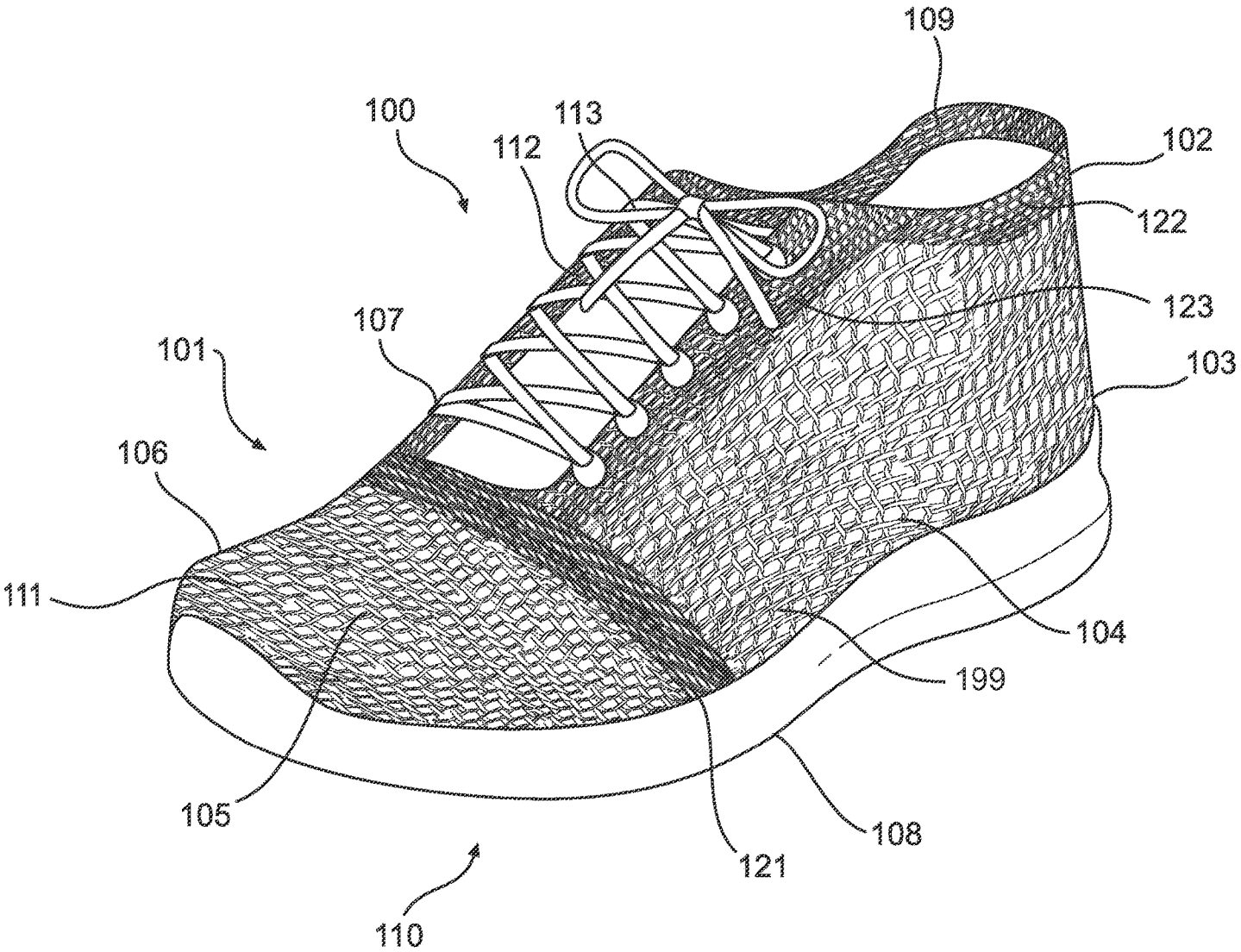
FIG. 3 is a schematic representation of a perspective side view of an embodiment of an article of footwear having a braided upper.

In some embodiments, articles of apparel and/or footwear may use one or more braided structures or configurations. In some embodiments, an article of footwear may include one or more regions that comprise a braided structure. For example, an upper may include one or more layers of a braided material. In one exemplary embodiment, a substantial majority of an upper can comprise a braided construction. One exemplary configuration is shown in FIG. 3, which comprises article of footwear 100 with a braided upper 101. The details of this particular embodiment are discussed below.

In some embodiments, uppers manufactured from braided materials may be much lighter than uppers manufactured using other materials. Such uppers can also be manufactured to be compliant with a wearer's foot. The perimeters of the material—for example at the ankle opening or at the throat of the upper—may be fixed using stitching, adhesives, fusing or another method so that the braid does not unravel. By controlling the density of the braid in different regions of the upper, those regions can be, for example, more soft and pliable for comfort, or stiffer for more stability and support. Specific examples of footwear with different braiding densities in different regions of the footwear are described below.

The braided upper can also be manufactured using strands made of different materials, as shown in certain of the embodiments described below. This provides additional flexibility in the manufacture of footwear for specific athletic or recreational activities. For example, strands made of a material with a greater tensile strength may be used in those sections of the footwear that undergo higher stress during a specific activity. Softer and more pliable strands may be used in sections of the footwear that are not subject to high stress, to provide a more comfortable and closely-fitting upper in those sections. Strands of an abrasion-resistant material may be used in particular regions of the footwear that may experience frequent contact against abrasive surfaces such as concrete or sand. Strands of a more durable material may be used in those regions of an upper that experience frequent contact with other surfaces, such as the surface of a football or soccer ball.

In some embodiments, strands with different material properties could be braided together, or otherwise associated with one another, to provide specific properties at one or more regions of an upper. For example, an upper may be fabricated from fibers that stretch to a certain degree, as the wearer's foot moves through each stride he or she takes, thus increasing the wearer's comfort. In that case, high tensile strength, non-stretch fibers may be threaded through those specific regions of the footwear that require additional structural support. As another example, an upper may be fabricated with a more open braid in some areas, for example to improve breathability or comfort. In that case, additional fibers may be laced through the braid to provide additional support in certain parts of those areas, or to provide increased durability for high-impact regions of the footwear.

The upper may also have floating cables, i.e., cables that are not braided into the fabric of the upper may be used to relieve the stress on certain sections of the upper. The floating cables may be made of a different material that is separate from and not attached to the braided structure. The cables may also be used as laces to secure the footwear to the foot, or to tighten up certain parts of the footwear, as described below. For example, the cables may be anchored at a first end at the sole of the footwear, and at a second end at an eyelet, for example. Such floating cables may also be used to add to the support and stability of certain parts of the footwear, such as around the ankle opening.

By using braiding, uppers for articles of footwear may be engineered with specific features tailored to a particular athletic or recreational activity. Braided uppers can be very light while conforming closely and comfortably to the wearer's feet. In some embodiments, the fit of the upper may be adjusted to provide the specific degree of tension or tightness the wearer may prefer. Braided uppers are characterized by close containment over the wearer's foot. In some embodiments, the braided fabric may wrap all the way around the footwear, as shown in the figures below. Such a structure has tensional integrity or "tensegrity," since the wearer's foot is in compression, while the braided strands are in tension around the wearer's foot.

The braided upper may be attached to a sole structure using adhesives, welding, molding, fusing stitching, stapling or other appropriate methods. The sole can include an insole made of a relatively soft material to provide cushioning. The outsole is generally made of a harder, more abrasion-resistant material such as rubber or EVA. The outsole may have ground-engaging structures such as cleats or spikes on its bottom surface, for providing increased traction.

Some embodiments may include braided uppers that extend beneath the foot, thereby providing 360 degree coverage at some regions of the foot. However, other embodiments need not include uppers that extend beneath the foot. In other embodiments, for example, a braided upper could have a lower periphery joined with a sole structure and/or sock liner.

FIG. 3 is a perspective side front view of an embodiment of an article of footwear, for example a running shoe. As illustrated in FIG. 3, the upper 101 of an article of footwear 100 can generally be described as having an ankle region 102, a heel region 103, a mid foot or instep region 104, a forefoot region 105, and a toe region 106. The article of footwear has an opening 109 at the top of the ankle region 102 that allows the wearer to insert a foot into the upper. Article of footwear 100 also has a medial side 107 and a lateral side 108. In the example shown in FIG. 3, the article of footwear also has a sole 110, a throat 112, and a shoelace 113. The sole of article of footwear 100 may be attached to the upper 101 by any of several well-known means such as by fusing, molding, welding, stitching, stapling or adhesives.

In some embodiments, upper 101 may comprise one or more layers of braided materials, as well as an optional outer covering, which is not shown in FIG. 3, but is discussed in further detail below with reference to FIG. 6. In particular, in some embodiments, upper 101 comprises a plurality of strands 111 that are braided together into a single braided construction having the overall geometry of a shoe last or foot. As previously discussed, the braided construction formed by plurality of strands 111 may not be uniform, so that the braided configuration and/or the materials of the braided strands could vary over different regions of upper 101.

In some embodiments, upper 101 may formed from a braided structure 199. Braided structure 199 may be a structure forming at least some portions of upper 101, including, for example, ankle region 102, heel region 103, midfoot or instep region 104, forefoot region 105, and toe region 106, as well as lateral side 108 and medial side 107. Braided structure 199 is formed as a unitary braided structure. As utilized herein, a braided structure (e.g., braided structure 199) is defined as being a "unitary braided structure" when formed as a one-piece element through a braiding process. That is, the braiding process substantially forms the various features and structures of the braided component without the need for significant additional manufacturing steps or processes. Further, as used herein, a unitary braided structure has structures or elements that share at least one common yarn, strand, filament or other braiding elements. Thus, it may be understood that whenever two or more portions or regions of a braided structure comprise part of the same unitary braided structure, these portions will share at least one common braiding element, such as a yarn, strand, filament or other element used to form braids.

As one example of a property of the braided construction that can vary across different regions of braided structure 199, and therefore upper 101 which is comprised of braided structure 199, the density of the braid can be varied. For example, in one embodiment, the plurality of strands 111 can be configured in a relatively open braid, as shown in the forefoot region 105 of article of footwear 100, or in a higher density braid, as shown by band 121 at the rear of forefoot region 105, band 122 around opening 109 and band 123 around throat 112. Bands with lower density braids may be lighter, more comfortable and more easily ventilated, while bands with higher density braids may provide additional stability, shape and strength. Also, different bands may be fabricated from strands having different physical or other properties, such as tensile strength, elasticity, diameter, shape or color.

In some embodiments, forefoot region 105, band 121, band 122 and band 123 all comprise portions of a common braided structure 199, which is a unitary braided structure. Therefore, though some properties may vary between forefoot region 105, band 121, band 122 and band 123, such as density, strength, etc., these portions may share at least one common yarn, thread, strand, filament or other braiding element.

It will be understood that each of the embodiments described in this detailed description and in the figures, of a braided upper, may be at least partially comprised of a unitary braided construction. Thus, two or more different portions of the uppers may always share at least one common yarn, thread, strand, filament or other braided element in common.

As previously discussed, some embodiments of upper 101 include an outer covering (not shown in FIG. 3). Outer coverings for braided uppers are described below in connection with FIG. 6, FIG. 18 and FIG. 19. For clarity, they are not shown in the other figures, since they would obscure the features being described. Other embodiments may use an inner covering or backing layer (see FIG. 6) between the braided structure and the wearer's foot, in addition to or instead of an outer covering.

Braided structures can vary in different embodiments. For example, braided structures can vary in structural properties such as the number of strands in the braid, the diameter of one or more strands of the braid, the density of the strands and the material properties of the strands such as elasticity, rigidity, tensile strength, compressibility as well as possibly other material properties.

The term "braided configuration" is used to refer to the relative disposition of different components, including braiding elements, braid density, strands, laces and floating cables. The configuration of a braided upper could vary over different regions of the structure. By incorporating regions with different braided configurations into an upper, the different regions can be configured with a variety of different properties, to improve the performance of the article of footwear and increase the comfort to the wearer. As an example, using a different braiding pattern at different portions of a braided structure within an upper may create different braid densities at these different portions, which may result in different ventilation properties for the portions.

The embodiments depict articles of footwear including uppers with portions having different braided configurations and/or different material properties. However, as previously discussed, these uppers may be formed of unitary braided structures, such that two different portions having different braided configurations may nonetheless share one or more common yarns, threads, strands, filaments or other braiding elements. Moreover, in at least some embodiments, different braided configurations may be achieved on different portions of an upper by varying the braiding pattern in some manner. In other words, in at least some embodiments, different portions of an upper having different braided configurations may share a substantially identical set of yarns, threads, strands, etc. Of course, in other embodiments, different portions of an upper may have some yarns of different material properties, though these different portions may still share at least one common yarn, thread or other braiding element.

FIG. 3 described above and FIGS. 4-19 described below illustrate different embodiments of uppers that are configured with various regions having substantially different braided configurations. The configuration of a braided upper can be engineered by using different densities of braids in different parts of the upper, by using different braid patterns, by using floating cables to produce additional tension in specific regions, or by using different braiding materials in different regions of the upper. For example, different portions of an upper could have different braid densities and/or could be comprised of strands having different stretch or compressibility characteristics. Varying the stretch and/or compressibility characteristics of one or more portions of an upper may help to control comfort and feel at different locations. For example, increased stretch or compressibility in some locations may reduce sag and change the feel of the upper. In some cases, using highly stretchable and compressible strands in at least some portions of an upper may give those portions a sock-like feel.

For example, the running shoe example shown in FIG. 3 has been engineered to provide the appropriate level of structural stability, support, durability and comfort, as follows. A band 121 of higher density braiding across the forefoot provides structural integrity across the forefoot as the runner pushes off against the ground. Higher density band 122 around opening 109 provides additional durability, padding and support for the region of the foot below the ankle. Higher density band 123 around throat 112 strengthens the region around the shoe lace, such that the wearer can pull on the laces to close the throat of the shoe around the wearer's foot. High density band 123 also provides greater durability to the region around the shoe lace. The lower density regions in the greater regions of the footwear result in a lighter footwear, more breathability and more comfort. In particular, for example, the forward part of forefoot region 105 as well as a majority of mid foot region 104 and heel region 103 are configured with a substantially lower density braid than the braid in band 121, band 122 and/or band 123.

Figure 4:
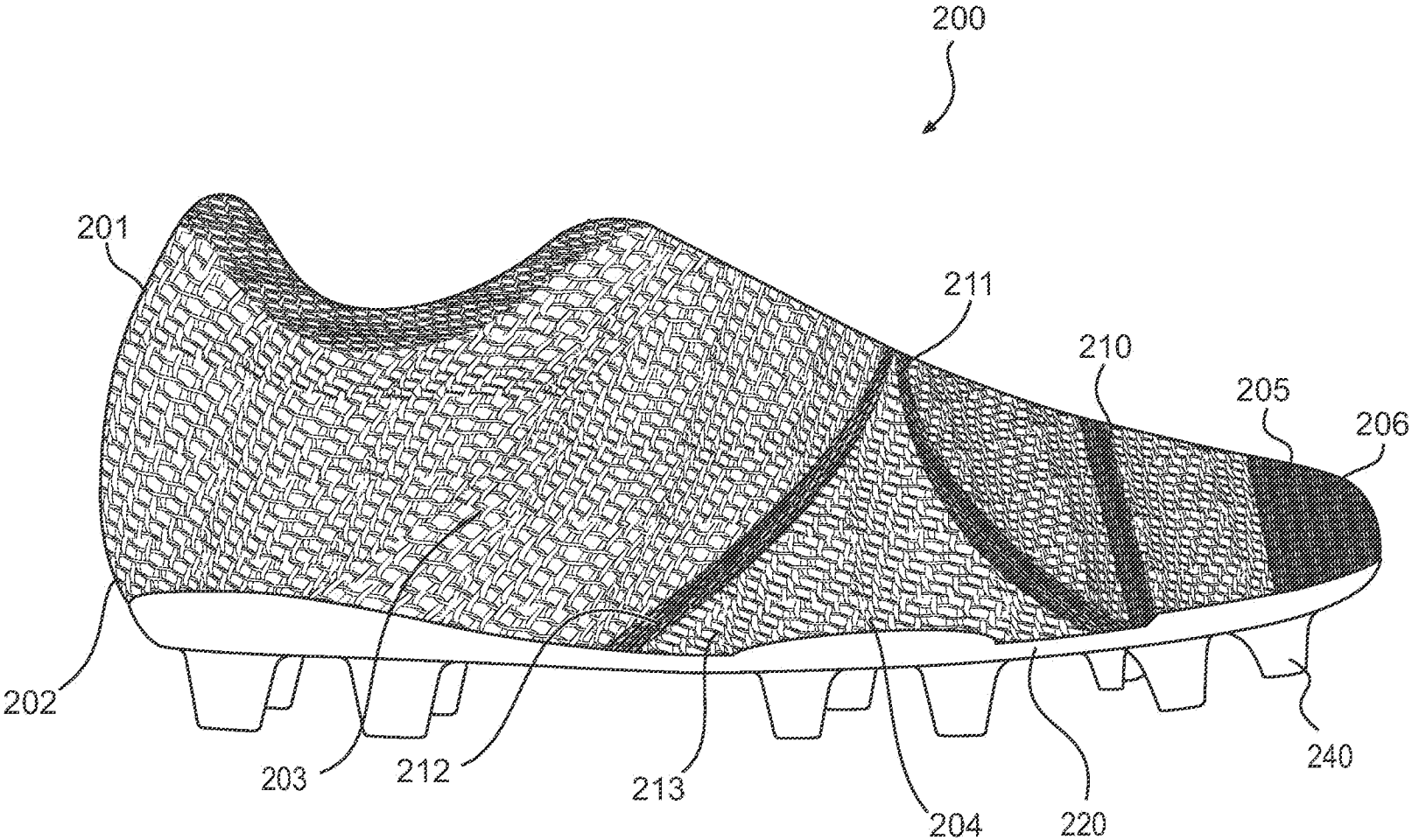
FIG. 4 is a schematic representation of a lateral side view of an embodiment of an article of footwear having a braided upper.
Figure 5:
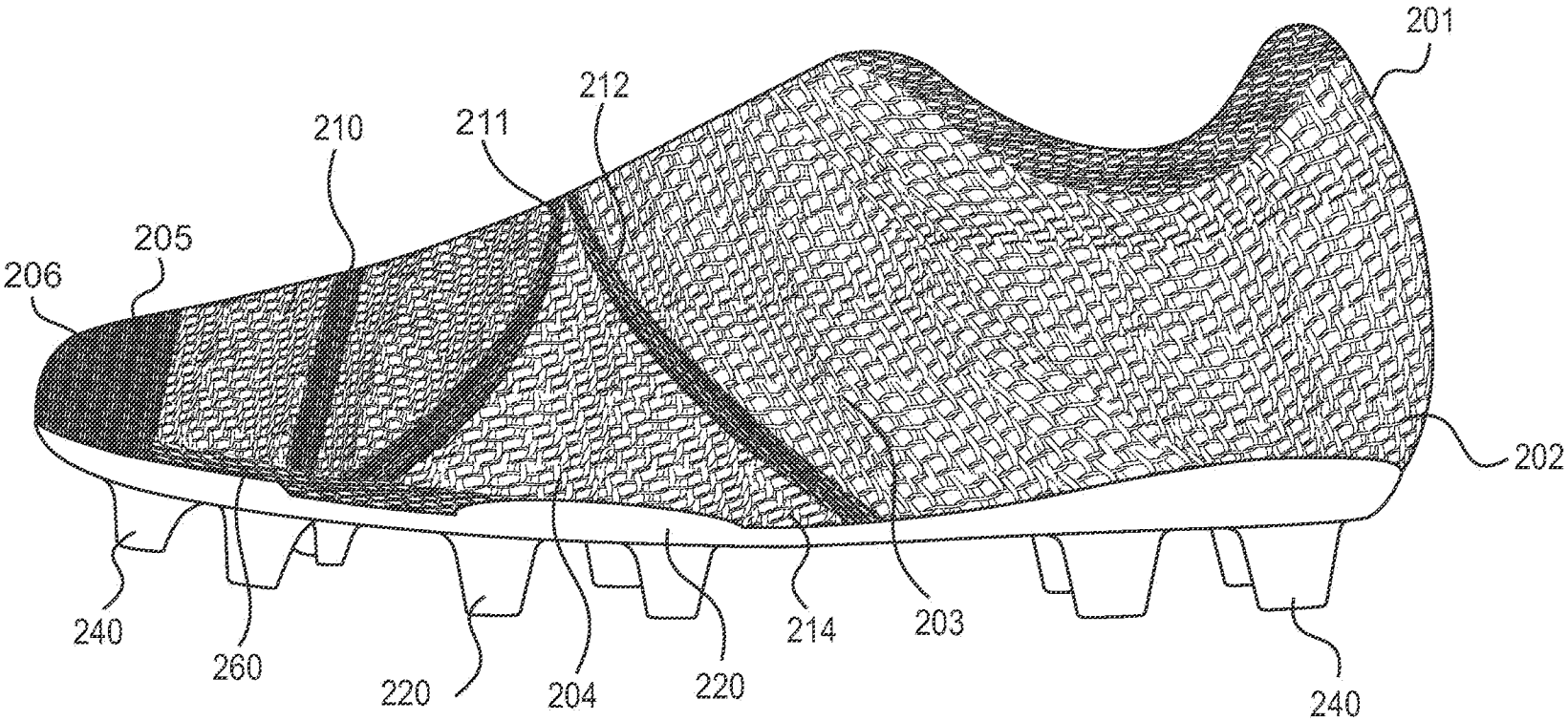
FIG. 5 is a schematic representation of a medial side view of the embodiment of the article of footwear shown in FIG. 4.

The use of braided materials with different braid densities shown in the example of FIG. 3 may be applied to a wide variety of footwear. For example, FIG. 4 and FIG. 5 are a lateral side view and a medial side view, respectively, of an example of an article of footwear with a braided upper 200 that may be used as a soccer shoe, for example. Braided upper 200 is shown without its outer covering in FIG. 4 and FIG. 5. FIG. 6 is a top front view of the footwear, showing the outer covering 250 of braided upper 200. The example shown in FIGS. 4-6 has a toe region 206, a forefoot region 204, a midfoot region 203, a heel region 202 and an ankle region 201. In some cases, sole 220 may have cleats 240 for improved traction. Upper 200 may be attached to sole 220 using stitching, stapling, overmolding, fusing, adhesives or other attachment methods.

The embodiment shown in FIG. 4 uses a high density braid 205 at toe region 206 to provide added protection at the toe of footwear 200. This embodiment may be used, for example, as a soccer shoe. In that case, a higher density braid at toe region 205 (especially at the medial side, which is shown in FIG. 5) of the forefoot protects the wearer's toes and forefoot as the wearer kicks the ball. The footwear has a lower density braid at heel region 202 and midfoot region 203, compared to the density of the braid in forefoot region 204 and toe region 205.

In some embodiments, upper 200 includes several bands or extended regions having braided configurations that differ from surrounding regions of upper 200. For example, a band 210 of higher density braid at the forefoot region 204 of the upper extends laterally from the lateral side 213 of the footwear to its medial side. Another band 211 extends from the same location diagonally over the instep to a location below the front of the ankle on the medial side. A similar band 212 extends from the lateral side at a location below the front of the ankle to the location on the medial side that is the endpoint for band 210. Thus band 211 and band 212 cross at the apex of midfoot region 203 of the upper 200. These high density bands provide compression and stability in selected regions of the midfoot region 203.

Figure 6:
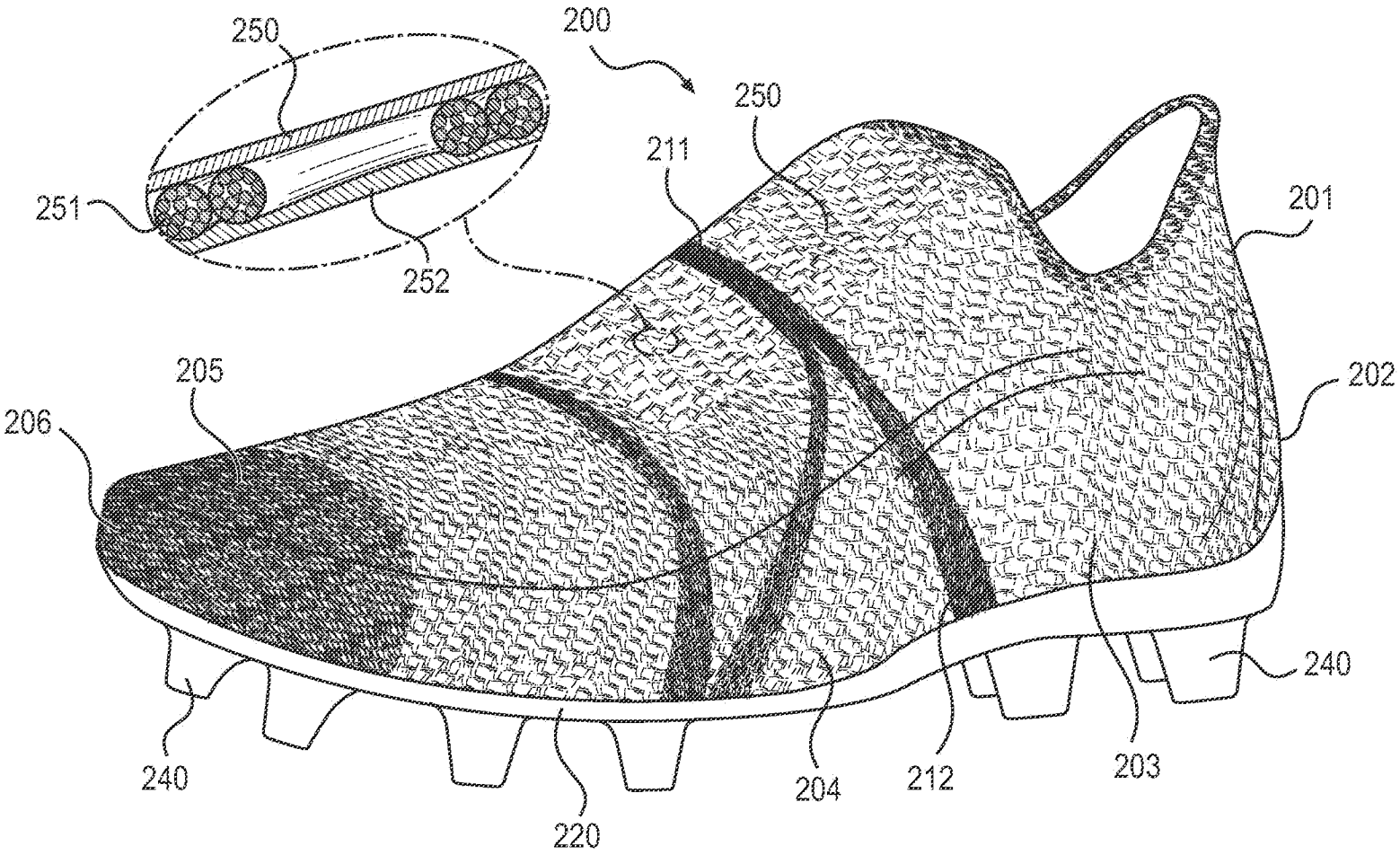
FIG. 6 is a schematic representation of a perspective top front view of the article of footwear shown in FIG. 4.

As can be seen in FIGS. 4-6, the upper 200 has a more open structure at midfoot 203, allowing for greater comfort and flexibility. It has a somewhat less open structure at the heel, ankle and forefoot regions, providing greater stability and compression around the ankle and the forefoot. Band 210, band 211 and band 212 provide compression at midfoot region 203, to restrain a wearer's foot from sliding within the footwear. The more open structure elsewhere at the midfoot provides a lighter upper with greater comfort to the wearer.

FIG. 5 and FIG. 6 are a medial side view and a top front perspective view, respectively, of the example of a braided upper 200 shown in FIG. 4. These figures show the high density braid 205 at the toe region 206, and in a band at the rear of forefoot 205. Band 21 0 has a higher density braid at the forefoot region 205 of the upper extending laterally from the lateral side 213 of the footwear to medial side 214. Band 211 and band 212 are higher density bands that extend diagonally over the instep and cross over each other at their apex. FIG. 5 also shows a high density region 260 at the portion of the forefoot adjoining the sole on the medial side of the footwear, which is a part of the footwear that would have frequent contact with, for example, a soccer ball. As noted above, high density region 260 at the forefoot and high density region 205 at the toe protect the wearer's toes and forefoot as the wearer kicks the ball, and provides for increased durability in those high-impact regions. These high density regions may optionally be fabricated from strands that have increased durability, abrasion resistance and wear resistance compared to the strands used for the other parts of the footwear. FIG. 6 is a perspective view of the upper of FIGS. 4 and 5. Upper 200 is shown in FIG. 6 with an outer covering 250. The braided structure is shown in phantom. In the call-out shown in FIG. 6, outer covering 250 is shown covering fibers 251 that form the braided structure of braided upper 200. The footwear may optionally also have an inner covering 252, on the interior side of the braided structure. The formation of an outer and/or an inner covering is discussed below with reference to FIGS. 18 and 19.

As previously mentioned, in some embodiments, different portions of a braided upper may comprise strands having different material characteristics, such as stretch and/or compressibility. For example, in some embodiments, band 210, band 211 and/or band 212 seen in FIGS. 5 and 6, could be made of strands that stretch less than the strands forming the adjacent portions of forefoot region 204 and midfoot region 203. In such embodiments, band 210, band 211 and band 212 may therefore undergo less stretching relative to adjacent strands, which may help band 210, band 211 and/or band 212 to function as integrated straps that keep upper 200 in place on a foot.

Figure 7:
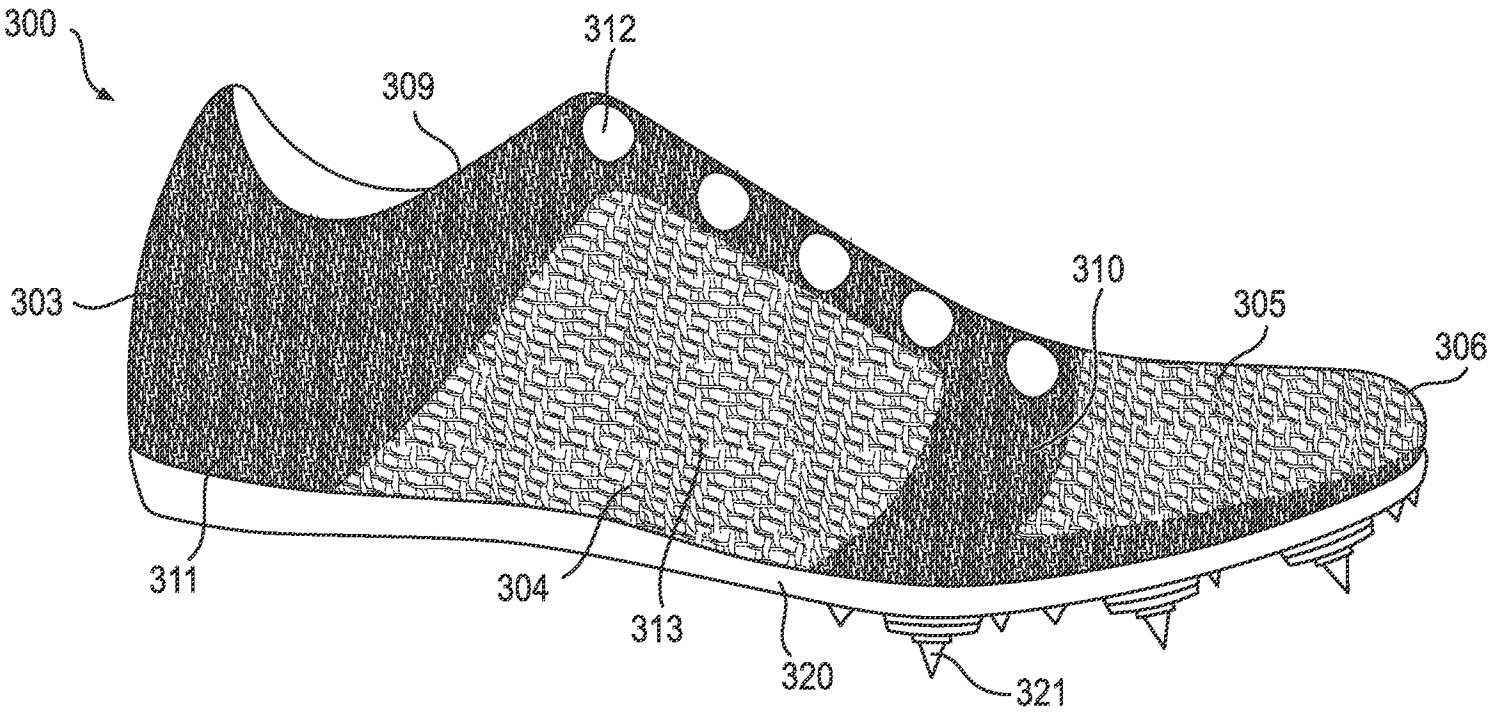
FIG. 7 is a medial side view of an embodiment of an article of footwear.
Figure 8:
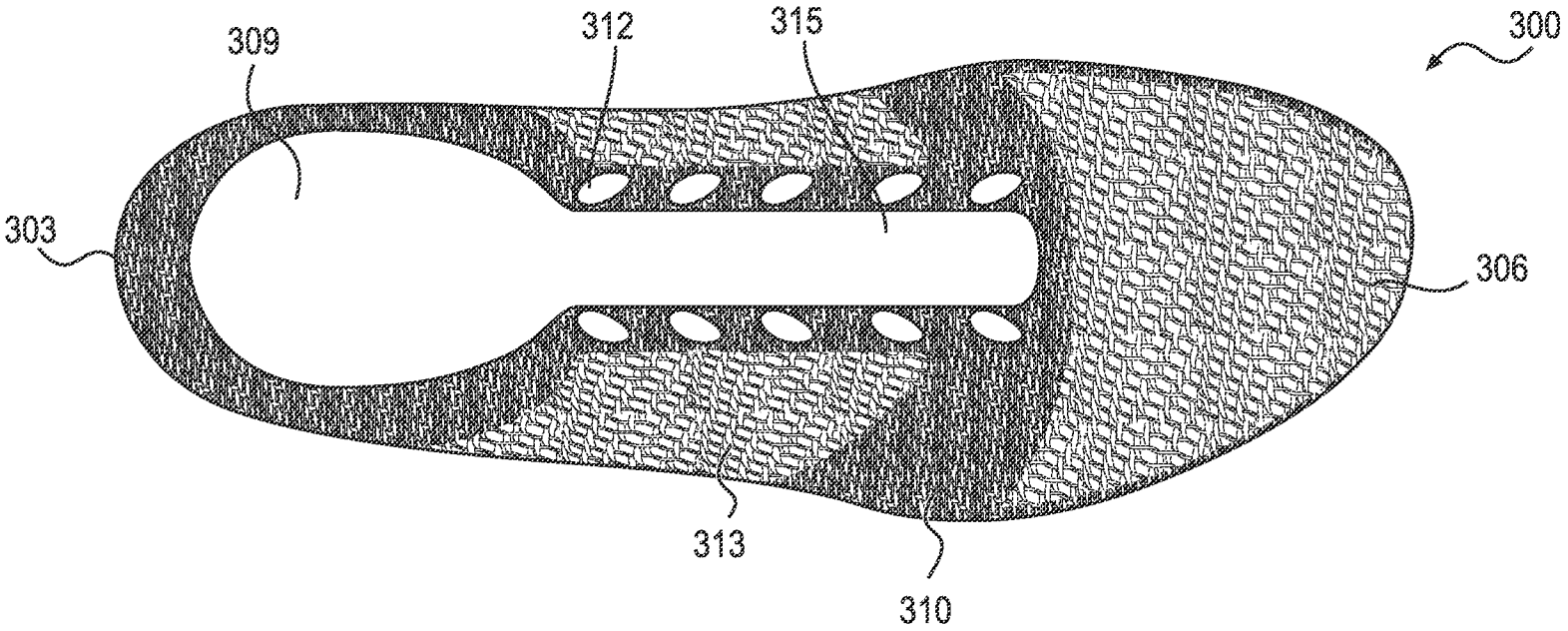
FIG. 8 is a schematic representation of a top view of the embodiment shown in FIG. 7.

FIGS. 7 and 8 are a medial side view and a top front perspective view, respectively, of another embodiment. This embodiment could be adapted for use as a track shoe, for example. In this embodiment, the article of footwear 300 has a heel region 303, a midfoot region 304, a forefoot region 305 and a toe region 306. Opening 309 allows a wearer to insert his or her foot into the footwear. It also has a thin outsole 320, which provides traction and cushioning. If used as a track shoe, outsole 320 could have spikes 321.

This embodiment may or may not have an outer covering or an inner covering such as the ones shown in FIG. 6. For convenience, this embodiment is shown in FIGS. 7 and 8 without an outer covering or an inner covering. This embodiment has a high density braided region 310 to the rear of forefoot region 305, and high density braided region 311 extending from the heel up to the front of the wearer's ankle. It also has a low density braided region 313 at midfoot region 304 of the footwear. This low density open-braided midfoot region allows the footwear to expand and fit comfortably around the wearer's foot. Unlike the embodiment of FIGS. 4-6, this embodiment has an open throat 315, as best seen in FIG. 8. It also has eyelets 312 formed on either side of open throat 315. Eyelets 312 can be formed in any manner. In some embodiments, eyelets 312 can be formed from open loops of the braiding material. In other embodiments, eyelets 312 can be formed by leaving openings in the braided structure as shown in FIGS. 7 and 8. In still other embodiments, eyelets 312 can be separate components attached to the edge on either side of the open throat using stitching, stapling, fusing or other attachment means.

Referring to FIGS. 7 and 8, some embodiments include strands made of different materials having different material characteristics. For example, in some embodiments, high density braided region 310, heel region 303 and strands surrounding eyelets 312 may be made of a first material that is substantially different than a second material comprising low density braided region 313. In some embodiments, the second material may have more stretch and/or compressibility than the first material. This configuration may increase stretch in low density braded region 313 to better fit the sides of a foot while reducing stretch in heel region 303, around eyelets 312 and across the rear of forefoot region 305. Such variations in material properties can help create necessary supporting structures within article of footwear 300 that frame or support the more flexible regions.

Embodiments of the upper may include mechanisms for adjusting the tension on the wearer's foot. In the embodiment shown in FIG. 9, an article of footwear 400 has a relatively lower density braid in the midfoot region 413, in the forefoot region 414 and in the toe region 406, providing improved comfort and breathability in those areas. In addition, article 400 has higher density band 410 across the footwear at the front of throat 415, high density band 422 around throat 415 and high density band 411 around opening 409, to provide added strength and stability in those regions. This embodiment uses a conventional shoe lace 421 to fasten article of footwear 400 around the wearer's foot.

In this embodiment, article of footwear 400 includes a plurality of strands 451 on either side of midfoot region 413 and a plurality of strands 452 on either side of the front of throat 415 that may be used to adjust tension around a wearer's foot. Plurality of strands 451 and plurality of strands 452 extend from the sole of the footwear up to eyelets on either side of throat 415. Plurality of strands 451 and plurality of strands 452 are floating with respect to the braid, i.e., they are not attached to the braid, except possibly at the sole end and at the eyelet end. They may be attached to the sole and to the eyelets, such that when shoelace 421 is tightened, the stress is experienced by plurality of strands 451 and plurality of strands 452, thus relieving the stress on the braided structure itself.

Other embodiments may use integrated laces to allow a wearer to adjust the tension on the sides of the footwear to his or her best preference. For example, the embodiment shown in FIG. 10 uses two different integrated laces, a medial side lace 421 and a lateral side lace 420, that are integrated into the sides of upper 400. Each lace is attached to the bottom of the footwear at the outsole, on its respective medial or lateral side. The medial side lace 421 is interlaced through the open braided midfoot region 404 on the medial side of the footwear to, for example, the top (or first) eyelet on the medial side of the throat opening. It is then laced through the second eyelet on the lateral side of the throat opening, the third eyelet on the medial side, the fourth eyelet on the lateral side, etc. The lateral side lace 420 is attached to the outsole of the footwear, and then laced through the open braided midfoot region 404 on the lateral side of the footwear, to the top (or first) eyelet on the lateral side of the throat opening. It is then laced through the second eyelet on the medial side of the throat opening, the third eyelet on the lateral side, the fourth eyelet on the medial side, etc. After being laced through the bottom eyelets on the medial and lateral sides, lace 420 and lace 421 can be tightened around the wearer's foot. The two laces can then be tied to each other using a bow knot 423 or any other suitable knot. Upper 400 has a high density region 410 providing increased tensile strength in the part of the upper that comes under tension when the laces are tied in bow 423. This version allows the wearer to create maximum tension between the top of his or her foot in front of the ankle and the front of the heel, without putting the braided structure itself under stress.

Figure 11:
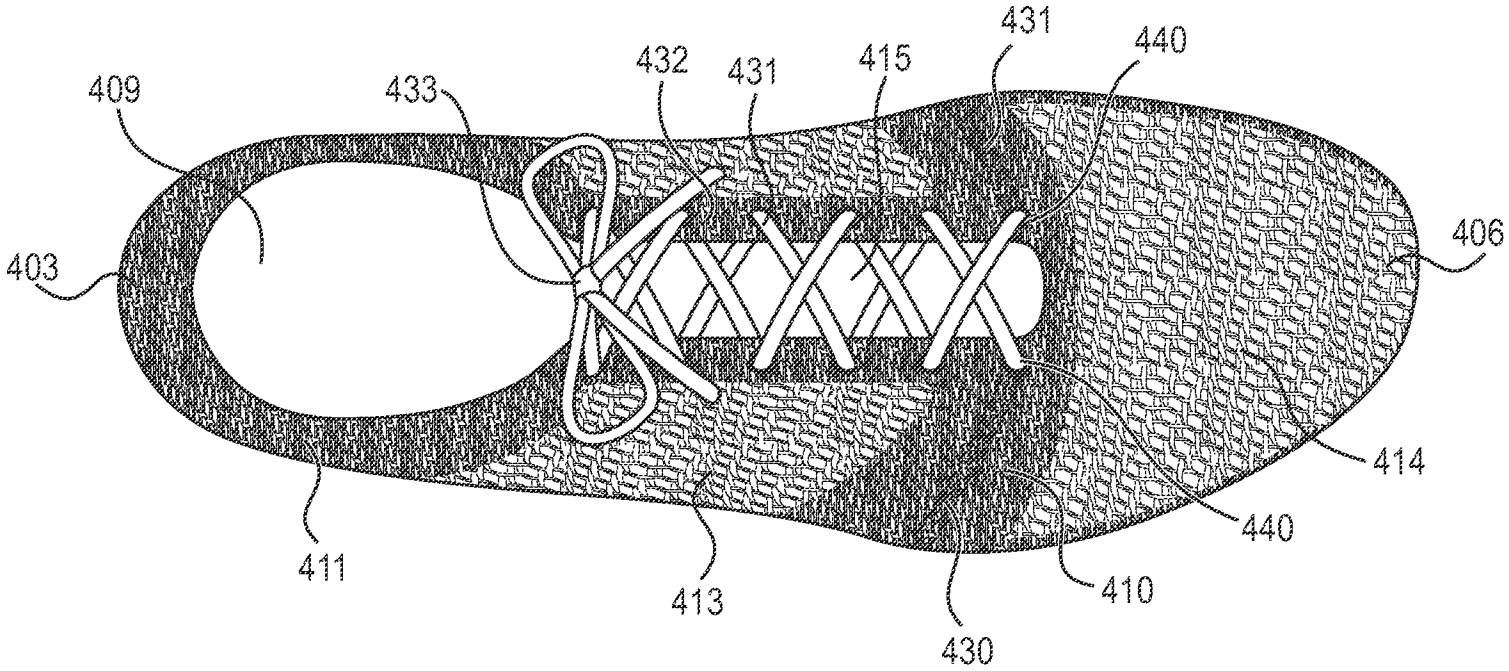
FIG. 11 is a schematic representation of another embodiment of an article of footwear using integrated laces.

In an alternative version of this embodiment, shown in FIG. 11, the laces may start from the forefoot region of the footwear at the outsole. In that case, lateral side lace 430 and medial side lace 431 are first laced through high density braid 410 to bottom eyelets 440, and the bow 433 knotting the laces together would be made after the laces have been laced through the top eyelets. Lace 430 and lace 431 can thus be used to tighten the upper around the wearer's foot at throat 415. High density braid 411 provides increased stability around the ankle opening and increased tensile strength when the laces are tied to form bow 433. This version creates the maximum tension between the top of the footwear and the eyelets in the forefoot, and results in a bow at the top of the foot near the ankle.

Figure 9:
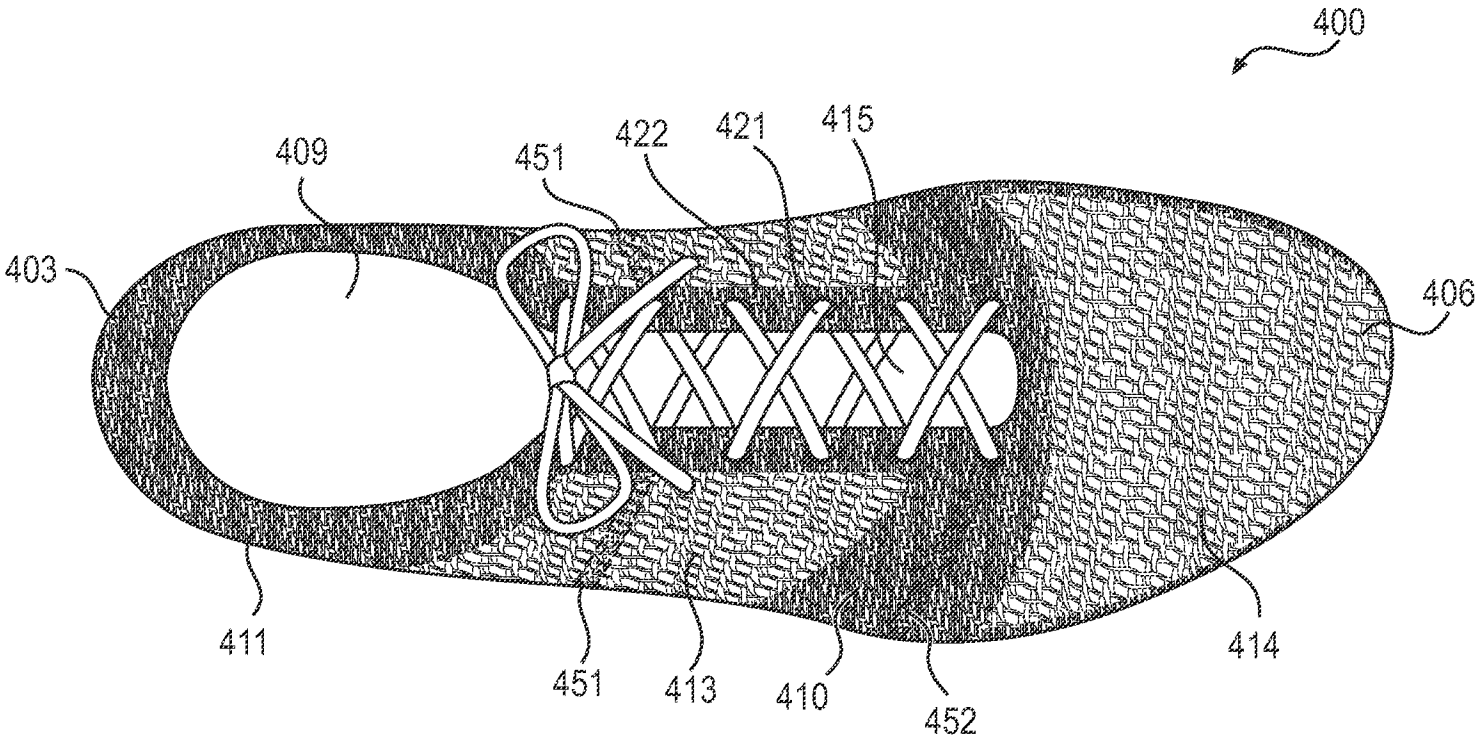
FIG. 9 is schematic representation of an article of footwear using floating strands.
Figure 10:
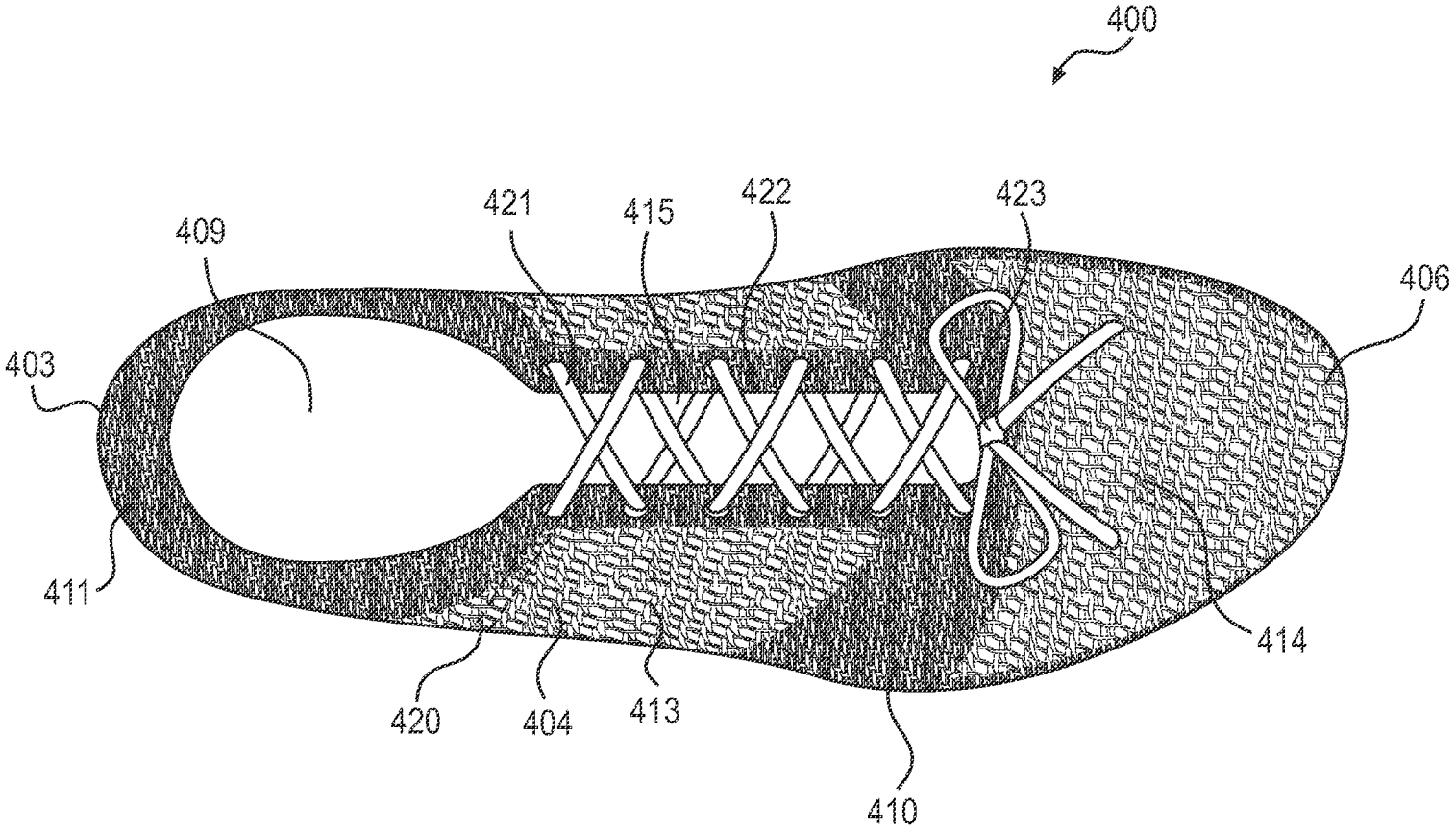
FIG. 10 is a schematic representation of an embodiment of an article of footwear using integrated laces.

It will of course be understood that the embodiments shown in FIGS. 9-11 can also utilize different materials for strands in different regions of upper 400. In particular, in some embodiments, regions associated with high density braids could utilize strands with less stretch and/or compressibility than the strands associated with lower density regions. Moreover, in alternative embodiments, two different regions could have similar densities but different material characteristics.

Embodiments can alternatively include integrated cables that provide specific properties to the braided upper. In some embodiments, the upper may have one or more integrated cables or other tensioning elements, to modify the tension control in a braided upper. The cables may be strands of the same material as the material used to fabricate the braided upper, but are more typically strands of a material having different properties, such as greater tensile strength, greater resistance to abrasion, or a different modulus of elasticity compared to the materials used to fabricate the fabric of the upper.

Figure 12:
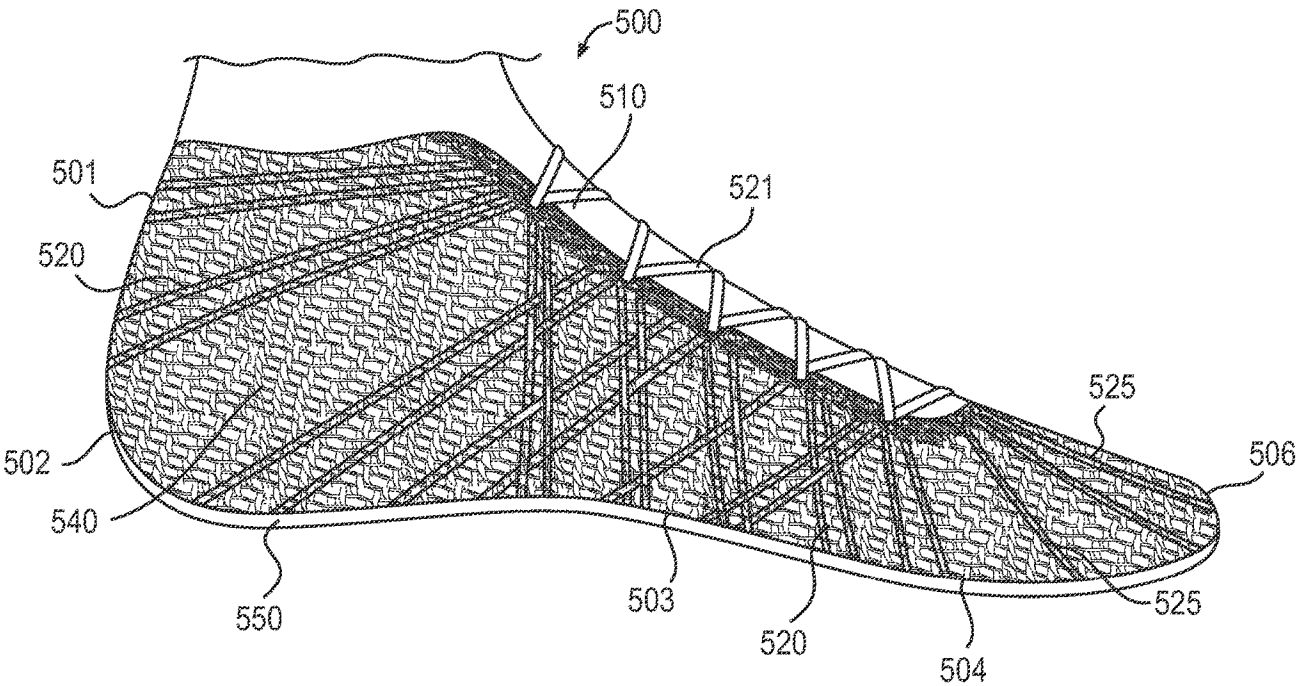
FIG. 12 is a schematic representation of an embodiment of an article of footwear using integrated cables.
Figure 13:
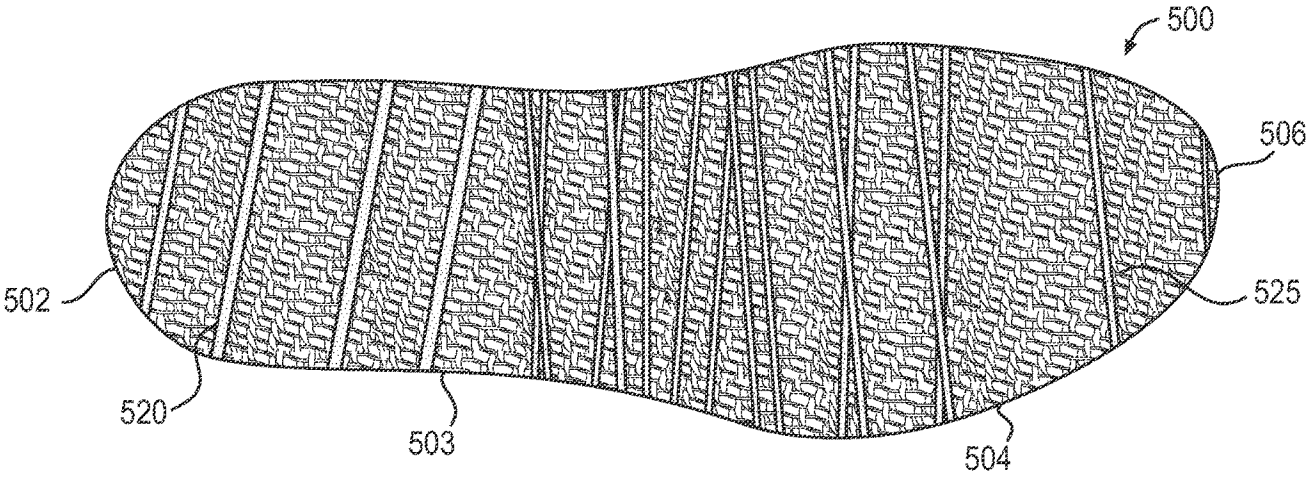
FIG. 13 is a bottom view of the upper of the embodiment of FIG. 12, before the upper is attached to a sole.

FIG. 12 and FIG. 13 are a side view and a bottom view, respectively, of an article of footwear 500 that includes integrated cables. FIG. 12 is an illustration of the footwear without an outer covering or an inner covering, which are optional. Outer and/or inner coverings such as those described in connection with FIG. 6, FIG. 18 and FIG. 19 may be used, for example. In this embodiment, floating cables 520 are laced through the braided structure 540 of the upper in the ankle region 501, the heel region 502, the midfoot region 503, the forefoot region 504 and the toe region 506, such that they can slide with respect to the braided structure. In the heel region, floating cables 520 may be attached at a lateral end to a lateral side eyelet and at a medial end to a medial side eyelet.

FIG. 12 shows that the article of footwear may include a sole 550. FIG. 13 illustrates the bottom of the footwear before a sole is attached. Floating cables 520 in the ankle region 501, heel region 502, midfoot region 503 and forefoot region 504, experience tension as shoelace 521 is tightened around throat 510 of footwear 500, thus relieving the stress on the braided structure in those regions of footwear 500, while maintaining compression over the wearer's foot. In addition, floating cables 525 extend from the front of throat 510 to toe region 506, and relieve the tension on the braided structure in the toe region.

Floating cables 520 and floating cables 525 provide an adjustable structure to the footwear. When shoelace 521 is tightened around a wearer's foot, floating cables 520 and floating cables 525 provide tensional integrity (or "tensegrity") to the structure of the footwear, because they keep the braided structure around the wearer's foot in compression, while experiencing tension as the wearer runs, jumps, turns or engages in other activities. Because the floating cables are not fixed except at their endpoints around throat 510, the tension on each of the floating cables is fairly evenly distributed around the wearer's foot.

In one alternative version of the embodiment shown in FIG. 12, the sole may have channels at its upper surface such that floating cables 520 and/or floating cables 525 are routed through the channels. In another version of this embodiment, floating cables 520 and/or floating cables 525 are routed under the sole. In yet another version, the floating cables are anchored at the sole at both the medial side of the sole and the lateral side of the sole. Each of these versions may optionally have an outer covering.

Figure 14:
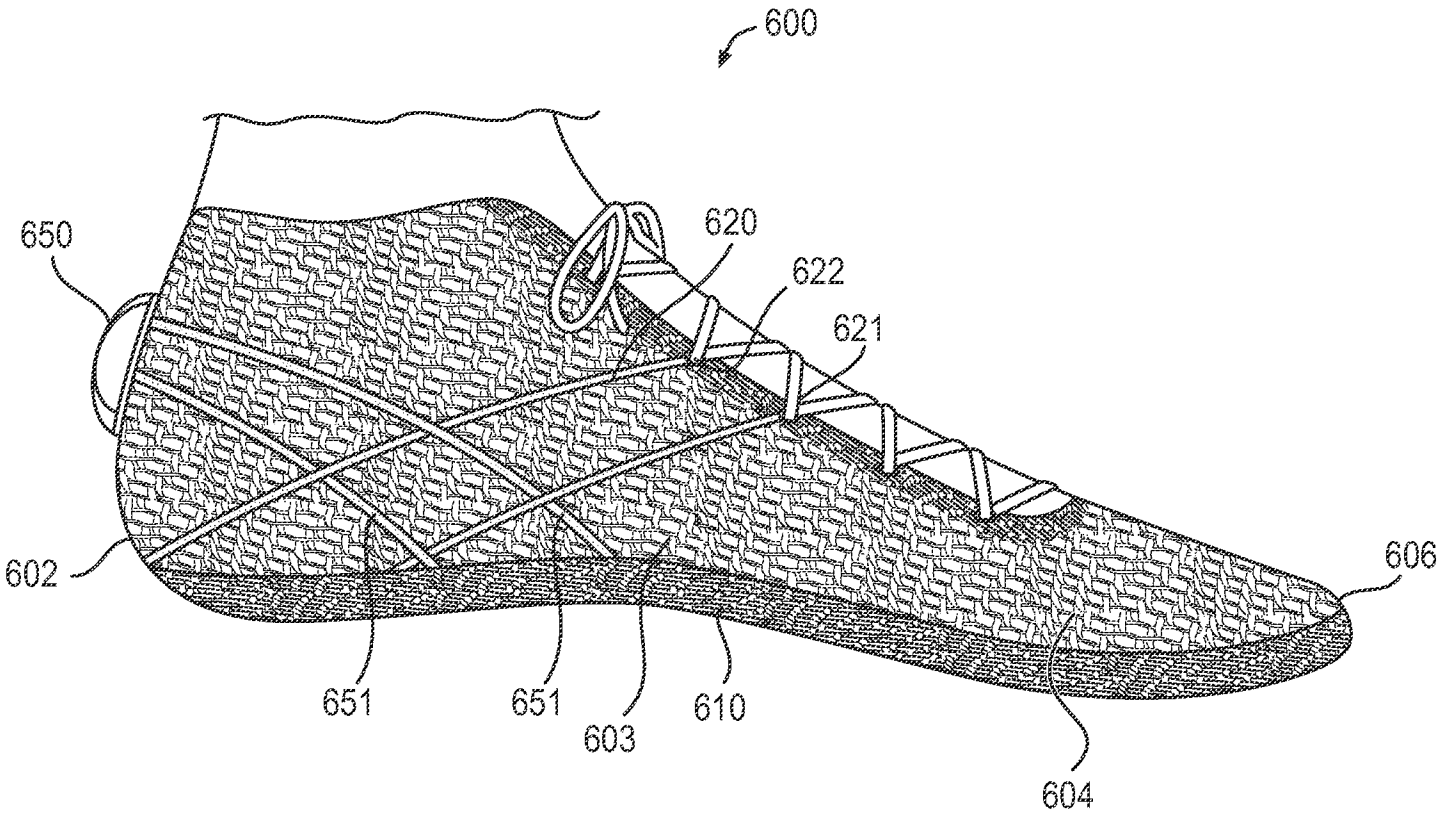
FIG. 14 is a schematic representation of an article of footwear having floating cables and a tensioning device.

FIG. 14 shows another embodiment of an article of footwear, shown without its outer covering, which is optional. This article of footwear 600 has a heel region 602, a midfoot region 603, a forefoot region 604, a toe region 606 and an outsole 610. Outsole 610 may be made of rubber or EVA. It may be fused to the upper, overmolded over the upper, or attached to the upper using stitching, stapling or adhesives. Article of footwear 600 also has floating cables 620 that are attached at one end to outsole 610, then are laced through the braids at heel region 602 and attached to eyelets 622 at the throat of the footwear. Cables 620 are placed under tension when shoelace 621 is tightened around the wearer's foot. Article of footwear 600 also has floating cables 651 that are laced through the braids from the front of the heel at the outsole in the heel region of footwear on the medial and lateral sides of footwear 600. Floating cables 651 are then gathered in tension control device 650, positioned in the back of the heel, as shown in FIG. 14. In some embodiments, a wearer can adjust the tension by manually twisting tension control device 650 to tighten or loosen cables 651. In other embodiments, tension control device 650 can be operated by a servo motor, such that a wearer can adjust the tension on cables 651 remotely. For example, a wearer could adjust the tension remotely while engaging in an athletic activity.

Tension control device 650 may be any device used to control the tension of the tensioning element. Examples of different tension control devices include, but are not limited to: reel devices with a ratcheting mechanism, reel devices with a cam mechanism, manual tensioning devices, automatic tensioning devices, as well as possibly other kinds of tensioning devices. Examples of a tensioning device comprising a reel and ratcheting mechanism that could be used with the embodiments described herein are disclosed in Soderberg et al., U.S. patent application Ser. No. 12/623,362 (published as U.S. Patent Application Publication Number 2010/0139057), filed Nov. 20, 2009 and entitled "Reel Based Lacing System", the entirety of which is hereby incorporated by reference.

In some embodiments, the tensioning device may be motorized, as described in U.S. Provisional Patent Application No. 61/695,953, entitled "Motorized Tensioning Device," which is incorporated by reference herein in its entirety.

Embodiments may also be engineered by using different braiding strands. In the embodiments described below, two or more different kinds of braiding strands are used to control the performance of the footwear. The strands used for the braid in certain regions of the footwear have different material properties, to produce increased or decreased tension, for example, in those certain regions of the footwear. The different braiding materials may also have greater abrasion resistance, greater flexibility or greater durability compared to the material used for the majority of the upper. In some embodiments, the different braiding materials could have different stretch. In some embodiments, the different braiding materials could have different compressibility.

Figure 15:
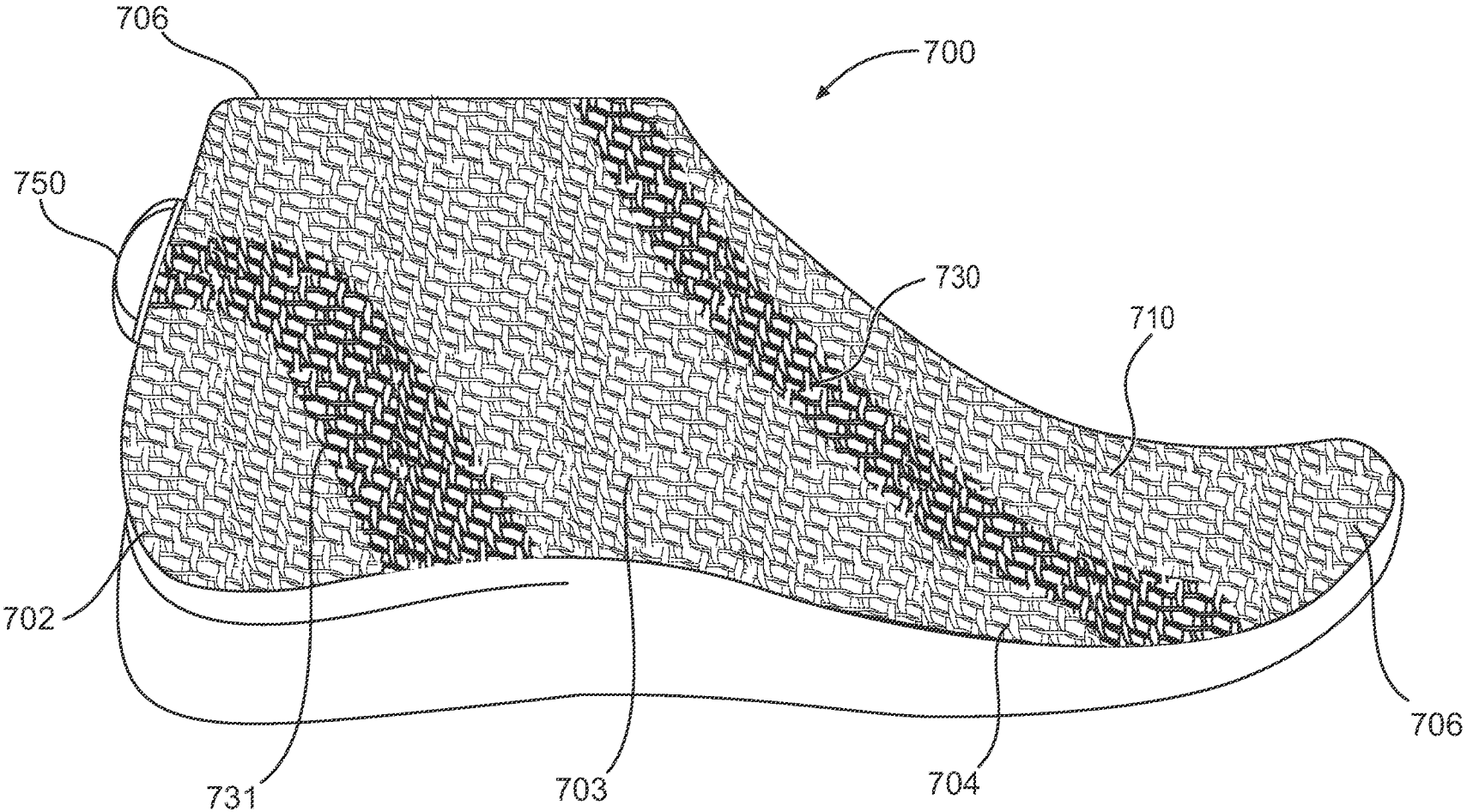
FIG. 15 is a schematic representation of a side view of an embodiment that uses different braiding strands.
Figure 16:
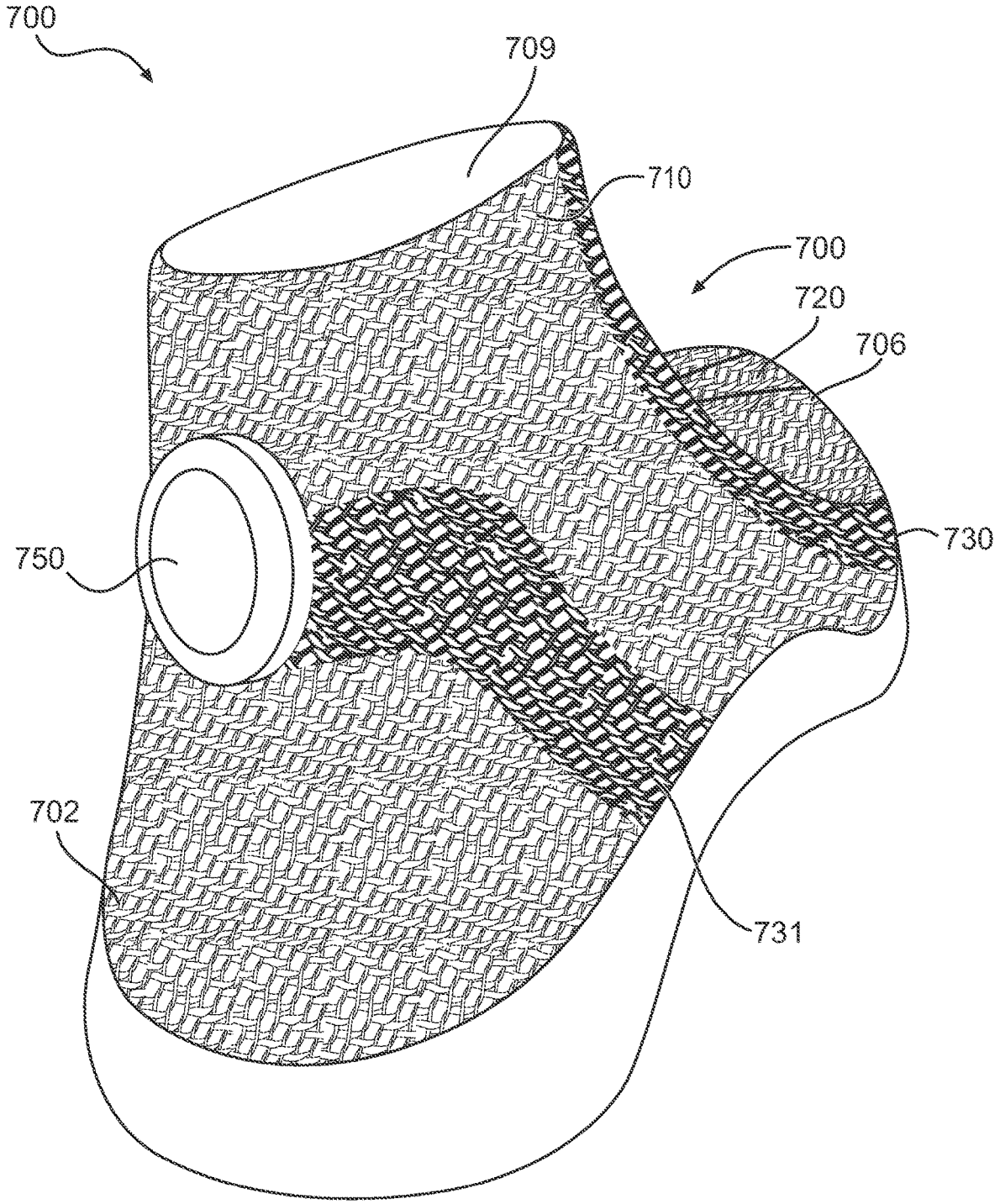
FIG. 16 is a rear perspective view of the embodiment of FIG. 15.

FIG. 15 and FIG. 16 are a side view and a rear perspective view, respectively, of such an embodiment, shown without an outer covering. In the example shown in FIG. 15 and FIG. 16, footwear 700 has a heel region 702, a midfoot region 703, a forefoot region 704 and a toe region 706. In this embodiment, the footwear is primarily formed using a first material for the strands 710 used to fabricate braided footwear 700. In addition, strands of a second different material having different characteristics may be used to form band 730 and band 731. Thus strands having different tensile strength, Young's modulus, thickness, color, flexibility and/or abrasion resistance may be used to form band 730 and/or band 731. For example, the strands used for these bands may have greater tensile strength to stabilize the footwear around the heel and from the top of the footwear near the ankle to the side of the forefoot, as shown in FIG. 15 and FIG. 16. As another example, the strands may have greater abrasion resistance when used in footwear intended for sports such as sand volleyball. Also, one or more of band 730 and band 731 may be of a different color, to produce a decorative effect, if the footwear does not have an outer covering or if the outer covering is transparent or translucent.

In the example shown in FIGS. 15 and 16, strands of band 731 may have greater tensile strength. Tensioning device 750 can be used to increase the tension from the back of the heel to the sole, as shown in FIGS. 15 and 16. In this example, strands 730 may have greater elasticity, and thus allow the upper to expand somewhat to allow a wearer to insert his or her foot into footwear 700.

In some embodiments, strands of band 730 and/or band 731 could be made of materials that stretch less than strands in regions adjacent to band 730 and/or band 731. In some embodiments, strands of band 730 and/or band 731 could be made of materials that compress less than strands in regions adjacent to band 730 and/or band 731. In still further embodiments, band 730 could be configured to undergo less stretching than band 731, while both band 730 and band 731 undergo less stretching than strands in some other portions of article 700. In such cases, band 730 and band 731 could be made of two different materials with significantly different stretching properties, while the remainder of article 700 could be made of a third material with still different stretching properties.

Figure 17:
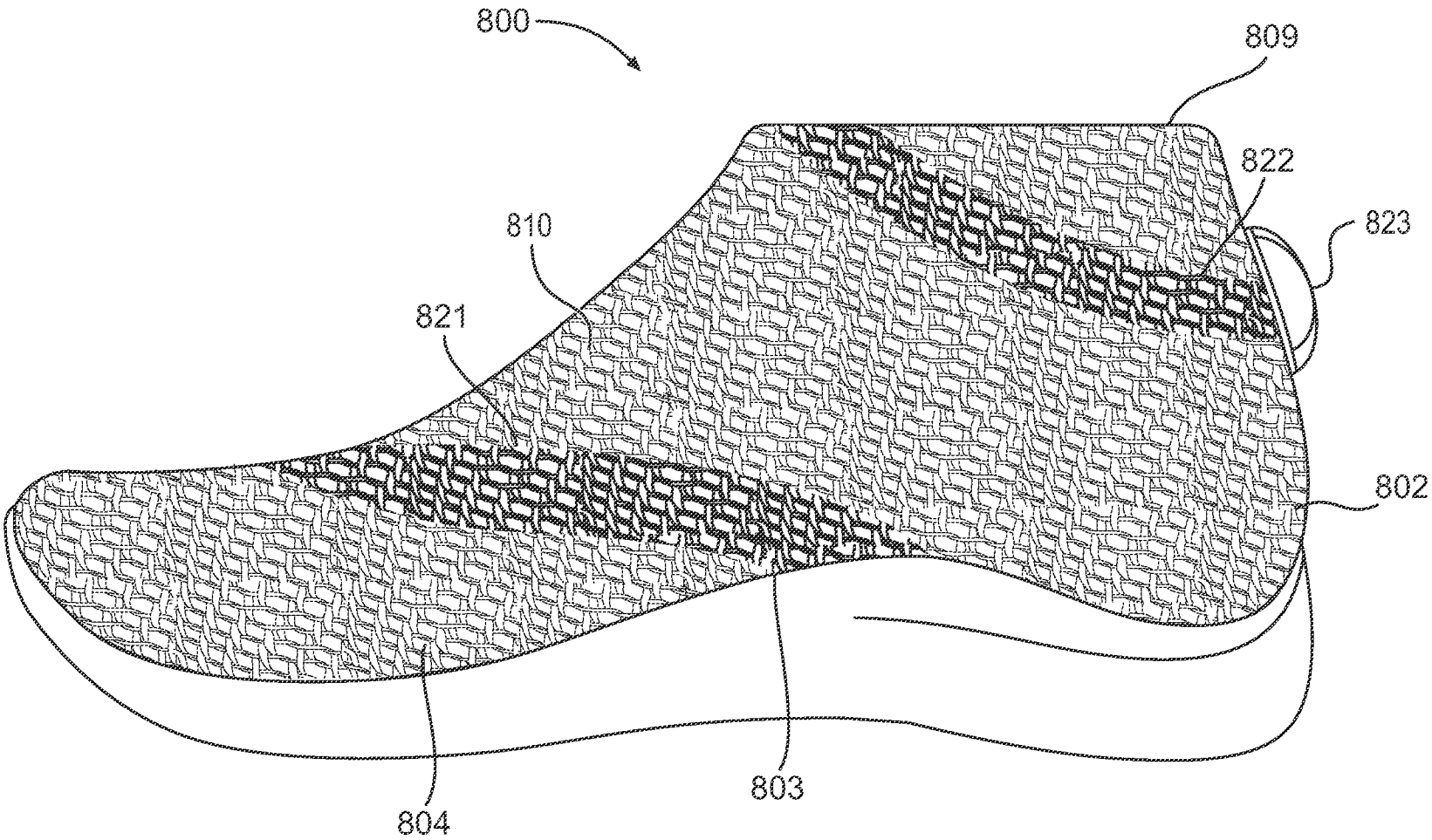
FIG. 17 is a side perspective view of another embodiment of an article of footwear that uses different braiding strands.

FIG. 17 shows another embodiment in which strands of a different material are used to stabilize the footwear around the wearer's foot or to provide a decorative effect. In this embodiment, footwear 800 has two bands that use strands of the different material. The strands for band 821 are laced through braids in braided material 810 from the midfoot region 803 over the apex of forefoot region 804. The strands used for band 821 may be more flexible and resilient that the strands used for braided material 810, to allow the forefoot part of the footwear to flex more comfortably. Band 822 may have strands that have greater tensile strength and less flexibility than the strands used for braided material 810, to provide increased stability around the ankle region of footwear 800. At the back of the heel, a tension control device 823 may be used to tighten band 822 around the ankle.

As noted above, any of the embodiments described herein may have an outer covering, an inner covering, or both an outer covering and an inner covering. An outer covering may be used to provide further protection to the braids and to the wearer's foot. The wearer's foot may optionally or alternatively be protected by an inner covering.

Figure 18:
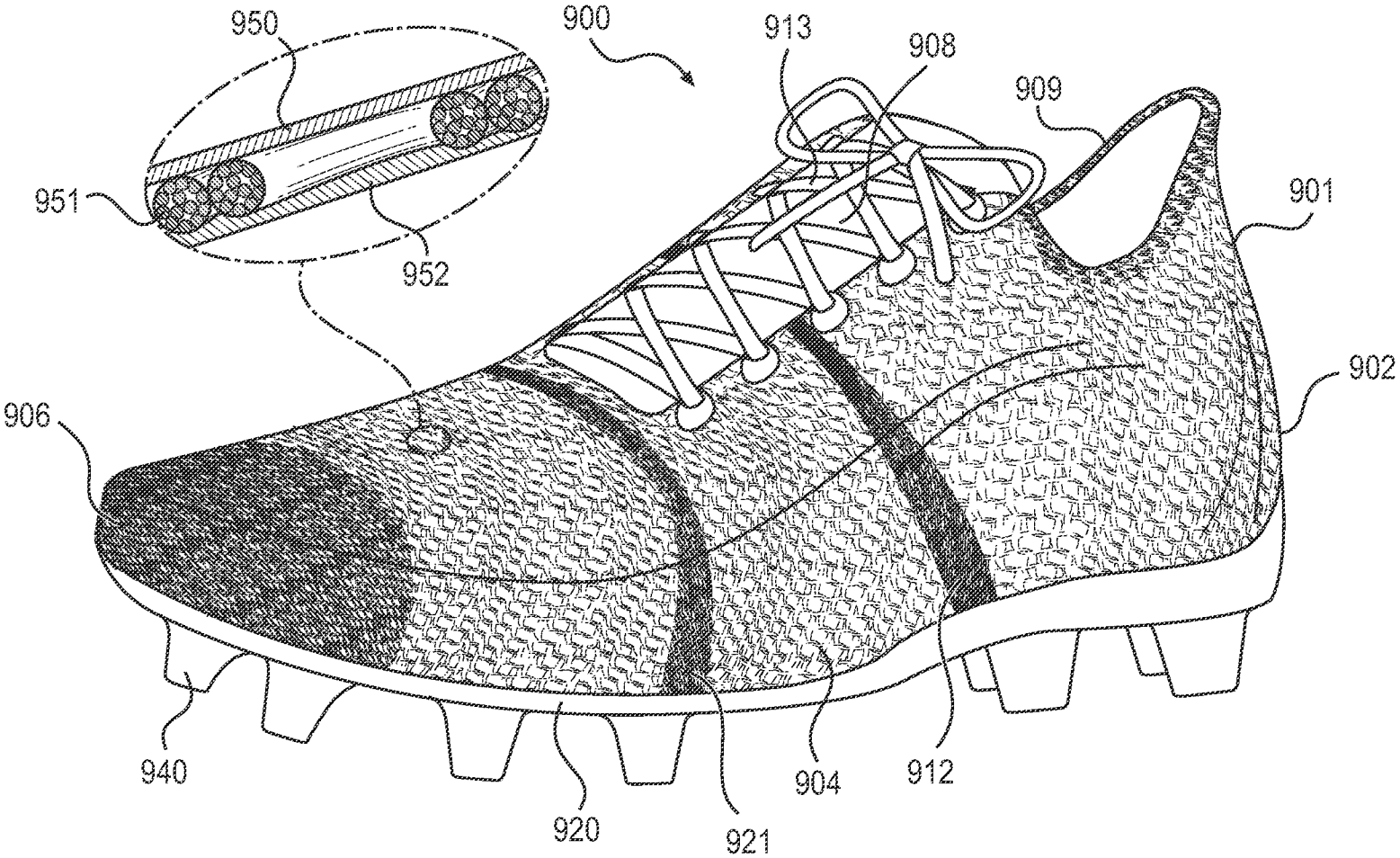
FIG. 18 is a top perspective view of another embodiment of an article of footwear with an outer covering and an inner covering.

For example, as shown the schematic diagram of FIG. 18, the upper 900 of an article of footwear has an outer covering 950 and an inner covering 952 on either side of braided fabric strands 951. Upper 900 has a high-density braid at its toe region 906, a band of high-density braid 921 in front of throat 908, and another high-density band 912 in part of midfoot 904. Band 912 experiences increased tension as shoelace 913 is tightened around a wearer's foot. Upper 900 has somewhat lower density braids in forefoot region 905, heel region 902, ankle region 901 and most of midfoot region 904. Upper 900 is attached to sole 920 by conventional means, such as by using adhesives, stitching, stapling, molding or fusing. Sole 920 may optionally have a ground-engaging component such as cleats 940 shown in FIG. 18 or spikes such as those shown in FIG. 7.

Figure 19:
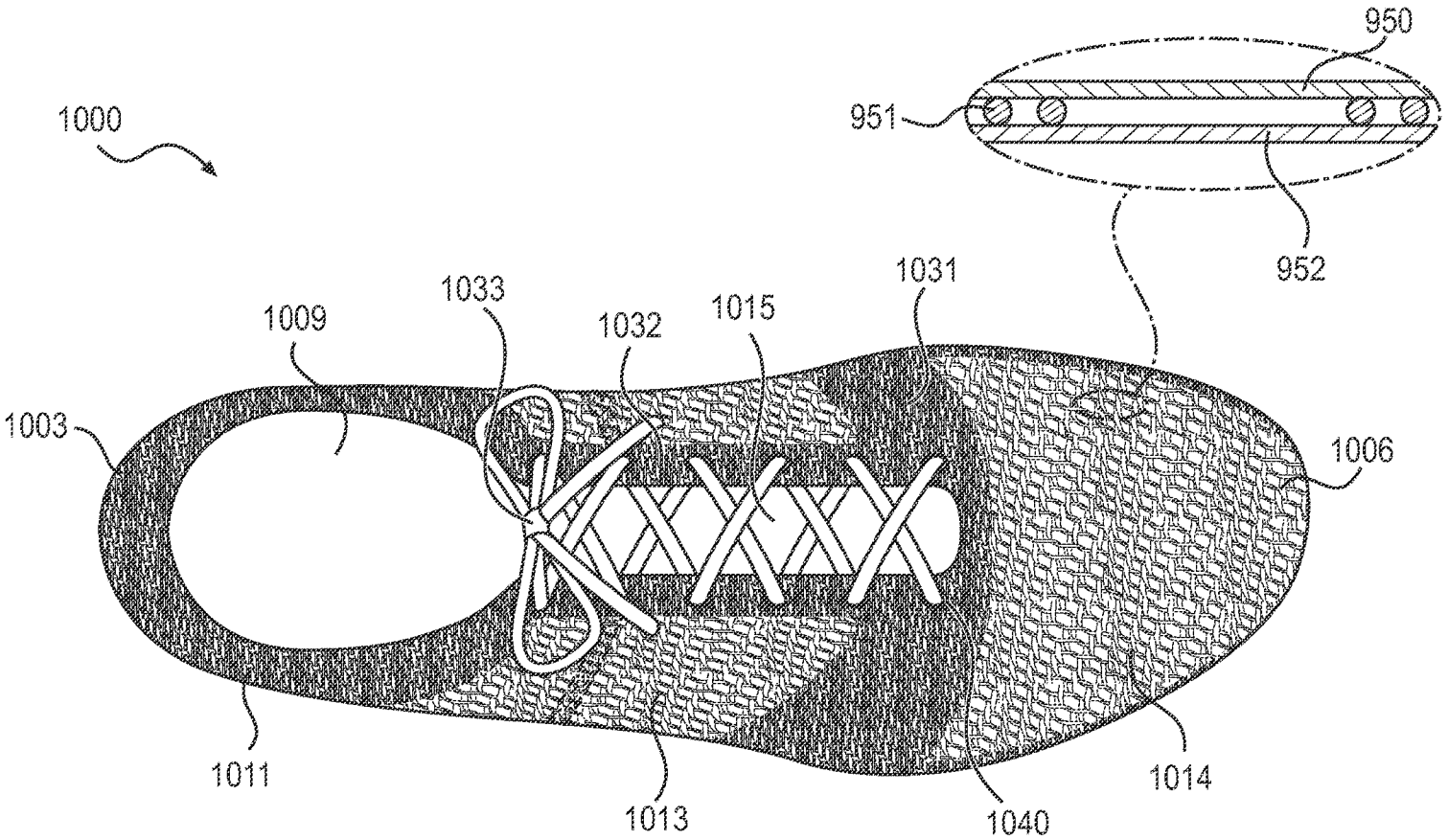
FIG. 19 is a top view of an embodiment with an outer covering and an inner covering.

FIG. 19 is a schematic diagram of another example of an embodiment of an article of footwear with an outer covering shown. In this embodiment, upper 1000 has a high density braid 1011 around ankle opening 1009 to provide more stability. Upper 1000 also has a band 1032 fabricated from higher tensile strength strands around throat 1015 because the perimeter of the throat may experience additional stress as the footwear is tightened around a wearer's foot. Band 1031 at the transition from midfoot 1013 to forefoot 1014 may be fabricated from a softer more elastic material, to allow the footwear to flex more comfortably. Upper 1000 has a relatively lower braid density in the forefoot region 1014 and toe region 1006, as well as part of midfoot region 1013.

Outer covering 950 and inner covering 952 (if used) shown in FIGS. 18 and 19—as well as outer covering 250 and inner covering 252 shown in FIG. 6—may be formed, for example, by spraying a last covered with the braided upper with thermoplastic polyurethane or polyester, or by dipping a last with the braided upper into a polymer solution and curing the solution in place. Outer covering 950 and/or inner covering 952 could be fabricated by laying a sheet of thermoplastic polyurethane (or another polymer layer or film) on one side or both sides the braided material, and then embedding the braids into the sheet(s) by applying heat and/or pressure. The inner covering may be used in addition to or instead of the outer covering. Inner coverings such as the one shown in FIG. 6 could be used with any of the embodiments disclosed herein.

Outer covering 950, as well as an inner covering or backing layer 952, may be formed by bonding a thermoplastic polymer to the braided structure, as disclosed in U.S. patent application Ser. No. 12/847,860, filed Jul. 30, 2010 and entitled "Article Of Footwear Incorporating Floating Tensile Strands," which is incorporated by reference herein in its entirety. Alternatively, outer covering 950 and/or inner covering 952 may be formed by molding, as disclosed in U.S. patent application Ser. No. 12/419,985, filed Apr. 7, 2009, entitled "Method For Molding Tensile Strength Elements," which is incorporated by reference herein in its entirety. Outer covering 950 and/or inner covering 952 could also be attached to the braided fabric by welding or fusing a polymer "skin" to the fabric.

The strands used to form the braided footwear may be made from fibers such as nylon, carbon, polyurethane, polyester, cotton, aramid such as Kevlar®, polyethylene, polypropylene or other materials. The soles and/or outsoles may be made of rubber, EVA or any other combination of suitable materials. The outer covering may, for example, be thermoplastic polyurethane or polyester. It may be formed over the braided region of the upper on a last by spraying or dipping, or it may be fabricated separately and attached to the braided region of the upper by stitching or welding or by using adhesives, for example.

In some embodiments, the strands forming the braided footwear are coated with a thermoplastic material, such as thermoplastic polyurethane, that softens at elevated temperatures. After the footwear is braided, all of the footwear or only regions of the footwear may be heated to a temperature such that the coated thermoplastic on each strand softens and melds with the coated thermoplastic on any strand that may be in contact with that strand. After the footwear has cooled down, the thermoplastic coatings become hard. Thus each coated strand is essentially fused or welded at every point that it comes in contact with another coated strand. This process further prevents the individual strands of the braided material from moving relative to each other, and thus further fixes and stabilizes the structure of the footwear.

As previously discussed, two or more different portions of a braided upper could be constructed of strands having different material properties. In addition, it is contemplated that some portions could comprise gradations in one or more material characteristics. Specifically, a stretchable or compressible material may be used in one or more locations. This stretchable material can provide the feel of compressibility when the material is stretched elastically. As an example, in one alternative embodiment, instep region 104 of upper 101 (shown in FIG. 1) could comprise strands that vary in stretch and/or compressibility from sole 110 to band 123. Thus, for example, the stretch, compressibility and/or other material characteristics of the strands could vary in a continuous or near-continuous manner over different portions. By varying the stretch and compressibility, for example, the upper can be configured to reduce sag at different locations and also to change the feel over different locations.

Figure 1:
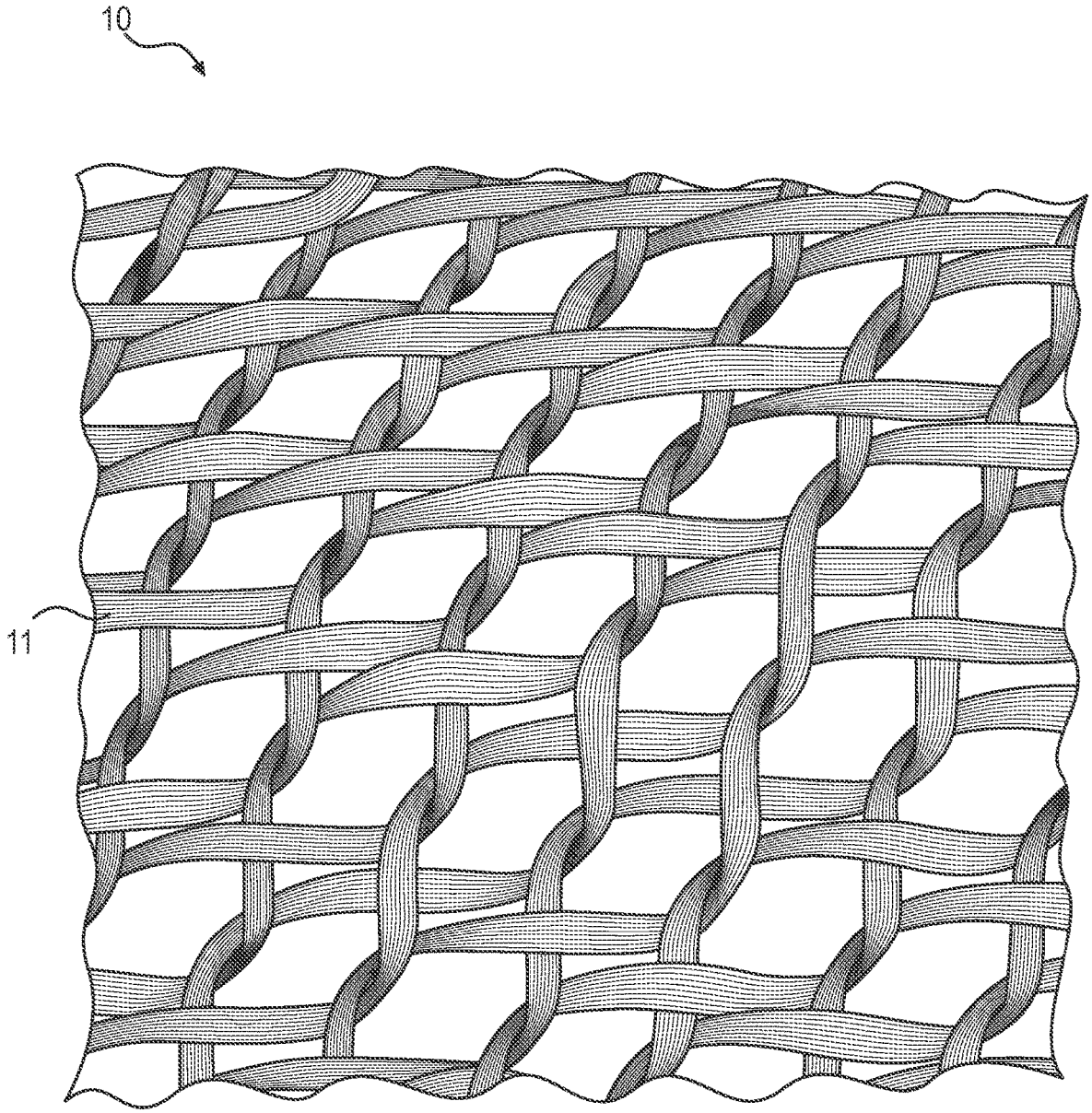
FIG. 1 is a schematic representation of a two-dimensional braided fabric.

The principles discussed in connection with FIG. 1 could be applied to each embodiment. In other words, in each embodiment with one or more braided regions, the stretch or compressibility of the regions could vary as described here.

Some embodiments may also incorporate materials whose characteristics change in response to different conditions. As one possible example, a braided upper could include a region with braided strands that stretch up to a predetermined amount (e.g., a predetermined percentage of their length) and then cease to stretch. In one embodiment, region 310 of article 300 (shown in FIG. 7) may be made of a material that stretches less than material comprising low density braided region 313. In addition, the strands of region 310 may undergo some stretching when tension is first applied, so that the strands stretch up to a predetermined percentage of their initial length, at which time the strands stop stretching. Such a configuration would provide motion limiting features for article 300. In particular, region 310 would initially stretch as the foot flexes or otherwise applies tension to article 300 and region 310 would apply a restraining force to the foot after the strands of region 310 stretched to a maximum length.

The principles discussed in connection with FIG. 7 could be applied to each embodiment. In other words, in each embodiment with one or more braided regions, one or more of the braided regions could be arranged to provide motion limiting features as described here.

The uppers for articles of footwear described herein may be made manually by braiding yarn, filaments or other fibers to form the patterns shown in the drawings. A last may be used to conform the upper to the desired shape and size. Cables as shown in FIG. 14 may be manually laced through the braided material. Strands as shown in FIGS. 15 and 16 may also be manually braided using different materials.

Some embodiments may utilize an over braiding technique to manufacture some or all of a braided upper. For example, in some cases, an over braiding machine or apparatus may be used to form a braided upper. Specifically, in some cases, a footwear last may be inserted through a braiding point of a braiding apparatus, thereby allowing one or more layers of a braided material to be formed over the footwear last.

Figure 20:
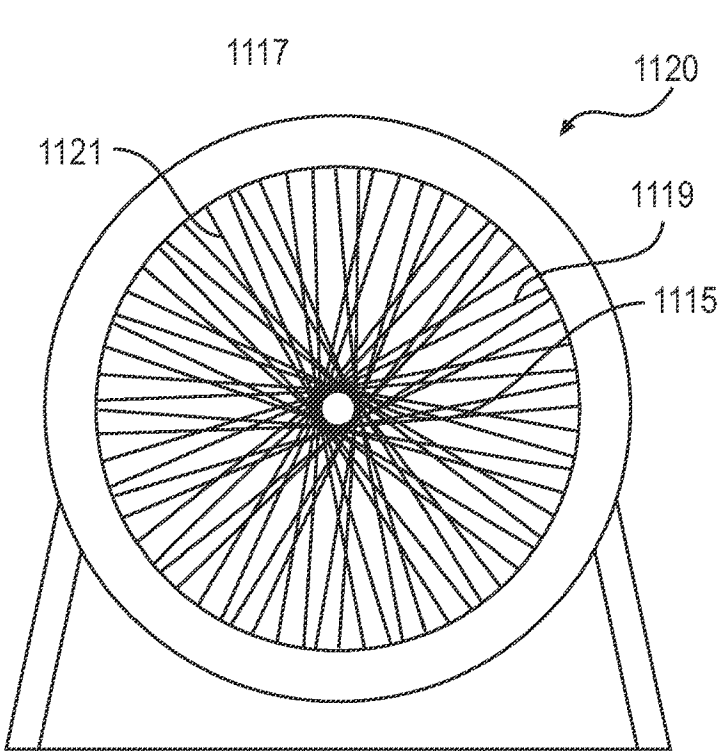
FIG. 20 is a schematic diagram illustrating overlast braiding.
Figure 20:
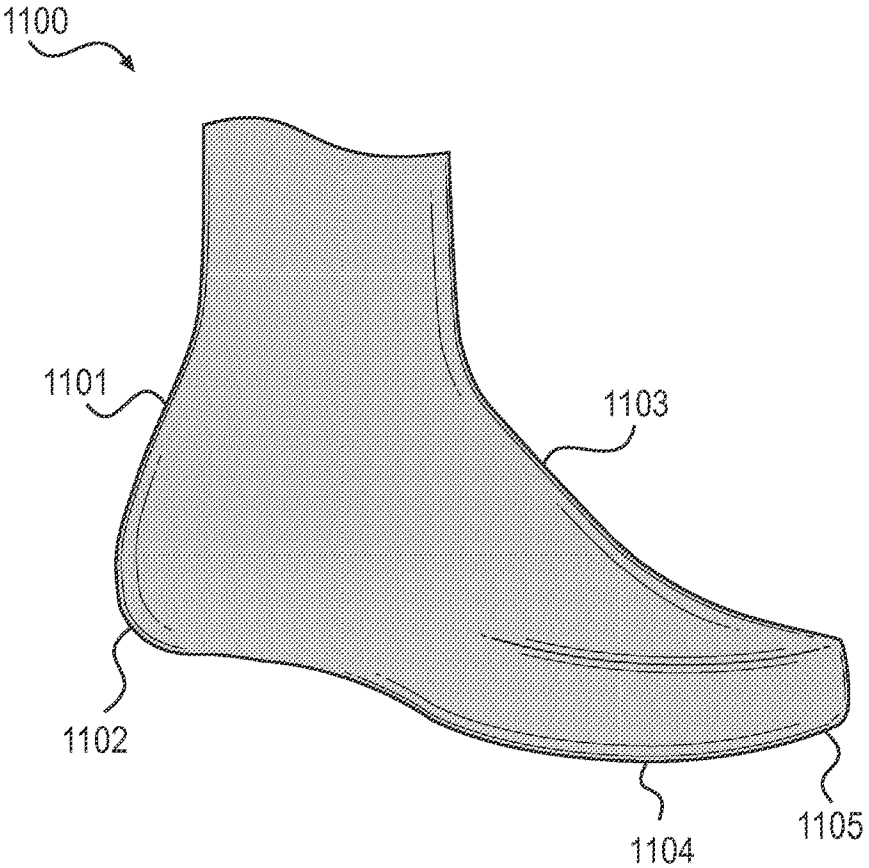

FIG. 20 is a schematic diagram illustrating an example of the use of a footwear last 1100 with an over braiding apparatus 1120 for the manufacture of a braided upper for an article of footwear. In some embodiments, last 1100 may be a conventional footwear last with an ankle region 1101, a heel region 1102, an instep or midfoot region 1103, a forefoot region 1104 and a toe region 1105.

Generally, over braiding apparatus 1120 may be any machine, system and/or device that is capable of applying one or more braided layers over a footwear last or other form. For purposes of clarity, over braiding apparatus 1120 is shown schematically in the figures. In some embodiments, over braiding apparatus 1120 may comprise an outer frame portion 1117. In some embodiments, outer frame portion 1117 may house one or more spools (not shown) of yarn 1119. Yarn 1119 may then extend from outer frame portion 1117 towards a central braiding point 1115. As discussed below, a braided upper may be formed by moving footwear last 1100 through central braiding point 1115.

In some embodiments, an over braiding system can include provisions to facilitate the creation of various different structures in a braided upper. In some embodiments, for example, an over braiding system can include provisions to facilitate the creation of eyelets or other openings in a braided upper. In other embodiments, an over braiding system can include provisions to create regions of different braiding density.

Figure 21:
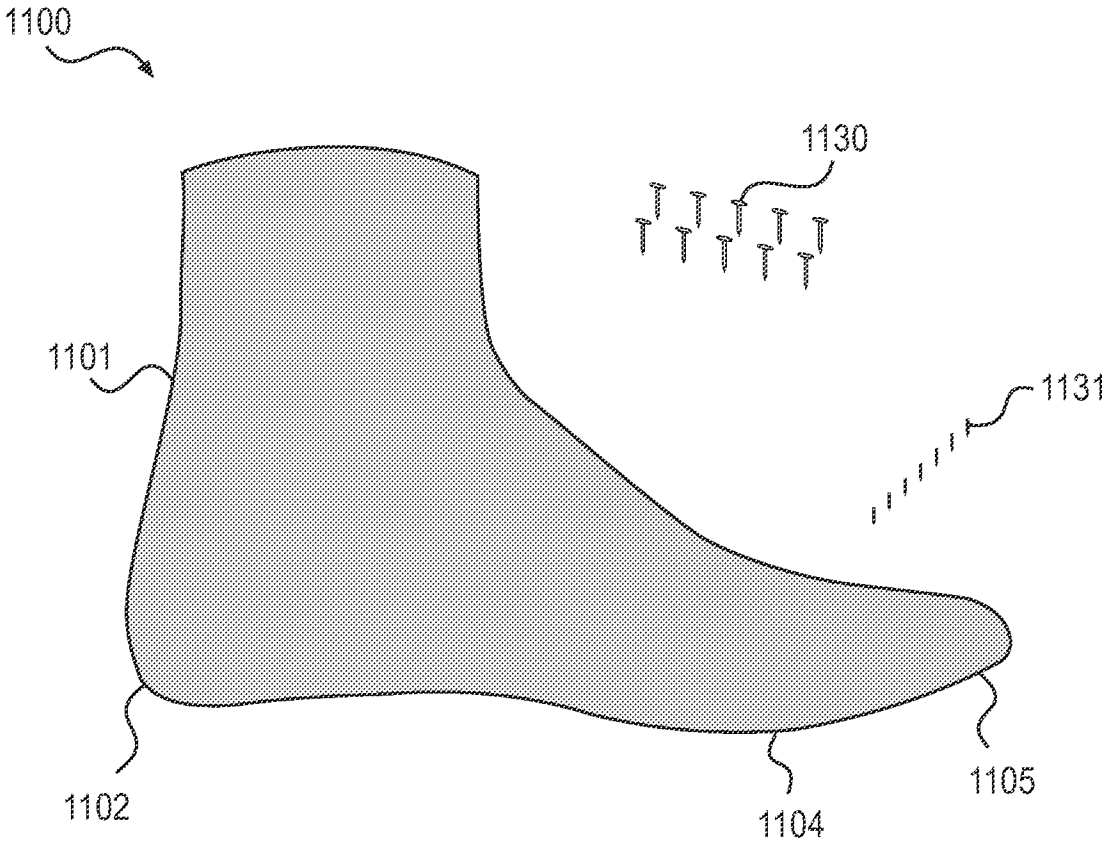
FIG. 21 is a schematic diagram illustrating the use of pins for overlast braiding.
Figure 22:
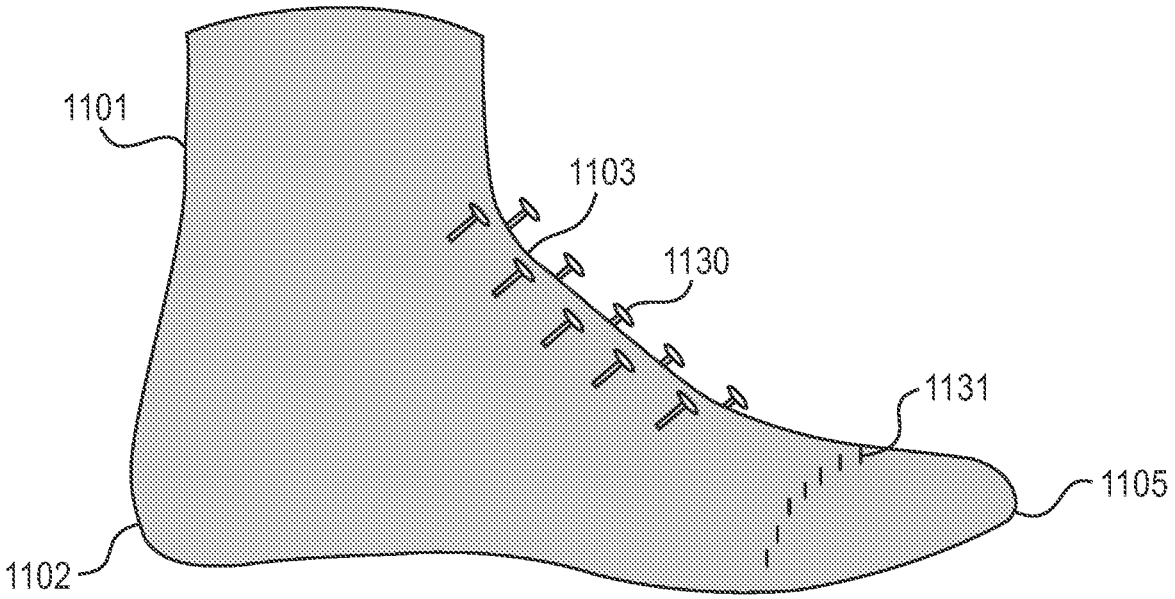
FIG. 22 is a schematic diagram illustrating the positioning of pins on a last prior to braiding.

Some embodiments may utilize pins or similar structures to enhance an over braiding technique. As an example, FIGS. 21 and 22 illustrate the use of pins of different dimensions and characteristics in different regions of the upper. In some embodiments, rows of pins with small pinheads 1130 may be used to delineate the eyelets around an upper's midfoot opening, i.e., to form eyelets for the footwear's shoelaces. Additionally, in some embodiments, a row of pins with no pinheads 1131 may be used to demarcate a high-density braid in the toe region 1105 of the upper.

Pins or similar structures may facilitate the creation of various structural features (such as eyelets or other openings) or of zones of different properties (such as densities) in a various manners. For example, placing pins with larger pin heads at locations of a last corresponding to eyelet holes may help prevent the buildup of yarn in these locations during the over braiding process, thereby helping to create openings and/or eyelets. As another example, demarcating different regions of a last with rows of pins can help provide visual cues to an operator of an over braiding apparatus to modify the braiding type and/or density of those regions as they pass through the central braiding point. Alternatively, in some embodiments, pins may interact with yarns to modify the tension of the braid at the pin location, which could affect the density of the resulting braid.

Figure 23:
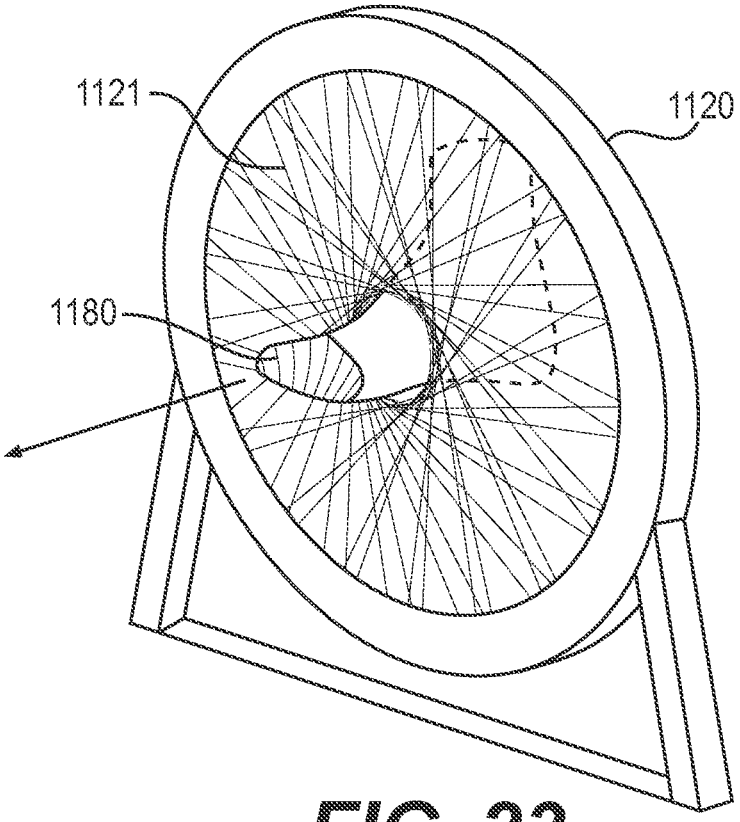
FIG. 23 is a schematic diagram illustrating braiding over a footwear last.

FIG. 23 is a schematic illustration of a braided upper as it is being manufactured in over braiding apparatus 1120. In this illustration, toe region 1180 of an upper has already been formed, and over braiding apparatus 1120 is forming the forefoot region of the upper. The density of the braiding can be varied by, for example, feeding the toe region 1105 of the last through braiding apparatus 1120 more slowly while the toe region is being formed (to produce a relatively higher density braid) than while the forefoot region is being formed (to produce a relatively lower density braid). The last may also be fed at an angle and/or twisted to form braided regions such as the regions shown in FIGS. 4-6, for example. The last may also be fed through the braiding apparatus two or more times in order to form more complex structures, or may alternatively be fed through two or more braiding apparatuses. In some embodiments, once the over braiding process has been completed, a braided upper may be removed from the footwear last. In some cases, one or more openings (such as a throat opening) can be cut out of the resulting over braided upper to form the final upper for use in an article of footwear.

It should be understood that in other embodiments, over braiding an upper on a footwear last can be accomplished without the use of an over braiding apparatus such as over braiding apparatus 1120 shown in the figures. In some embodiments, for example, over braiding can be achieved by manually braiding yarns around a footwear last. Still other embodiments could incorporate a combination of automatic over braiding methods and manual over braiding methods.

Figure 24:
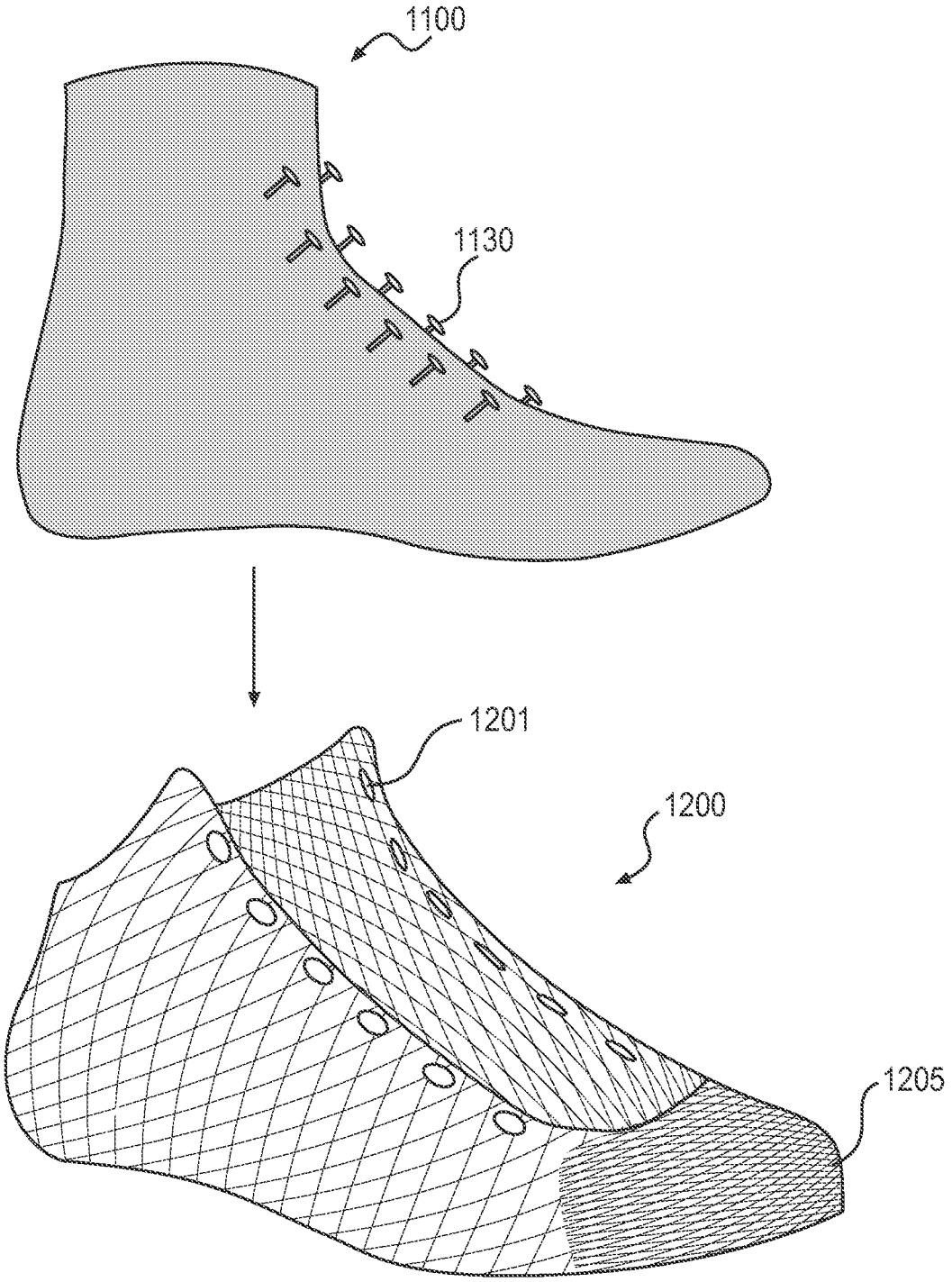
FIG. 24 is a schematic diagram illustrating an embodiment of a braided upper for an article of footwear and a last that could be used to manufacture that embodiment.
Figure 25:
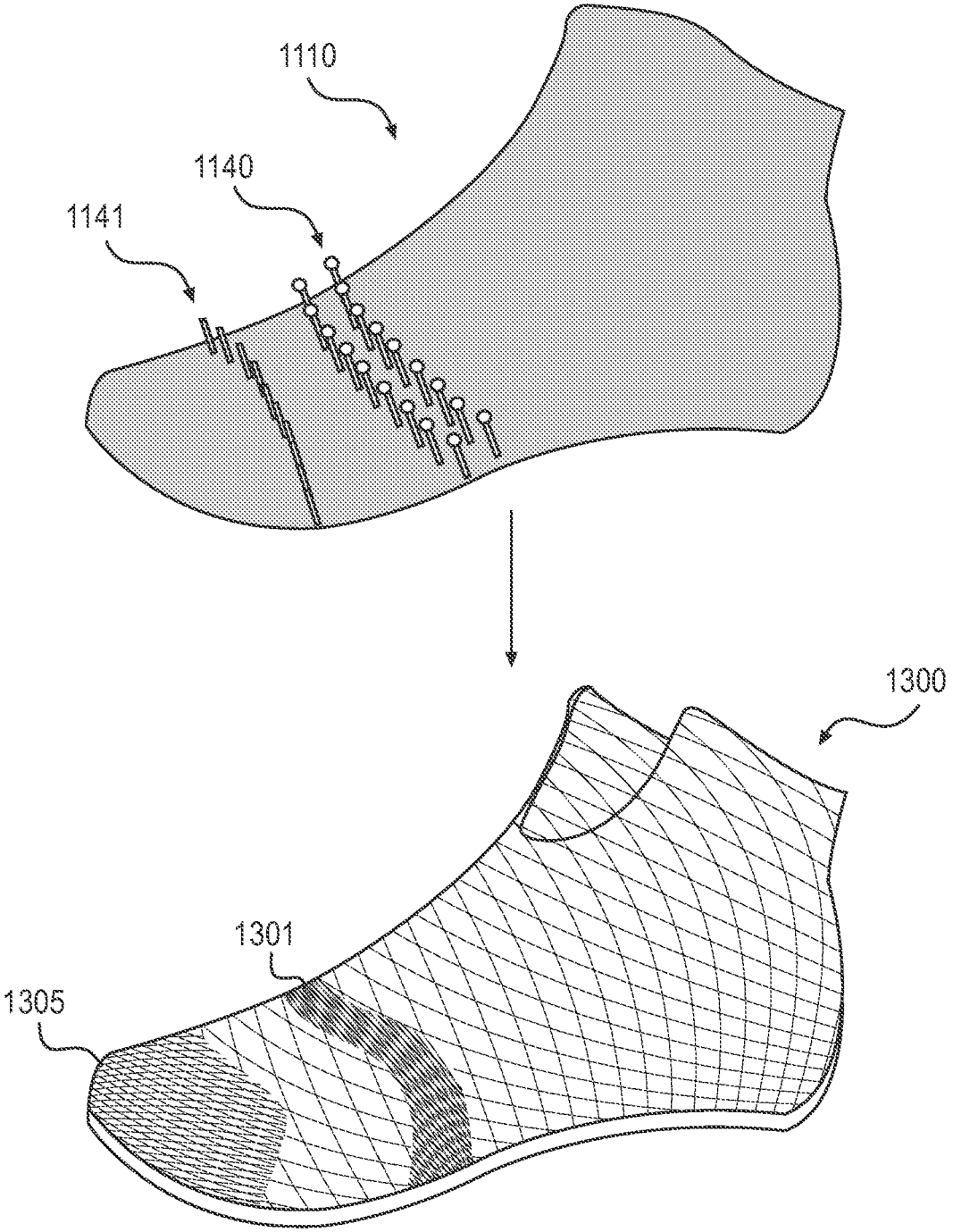
FIG. 25 is a schematic diagram illustrating another embodiment of a braided upper for an article of footwear and a last that could be used to manufacture that embodiment.
Figure 26:
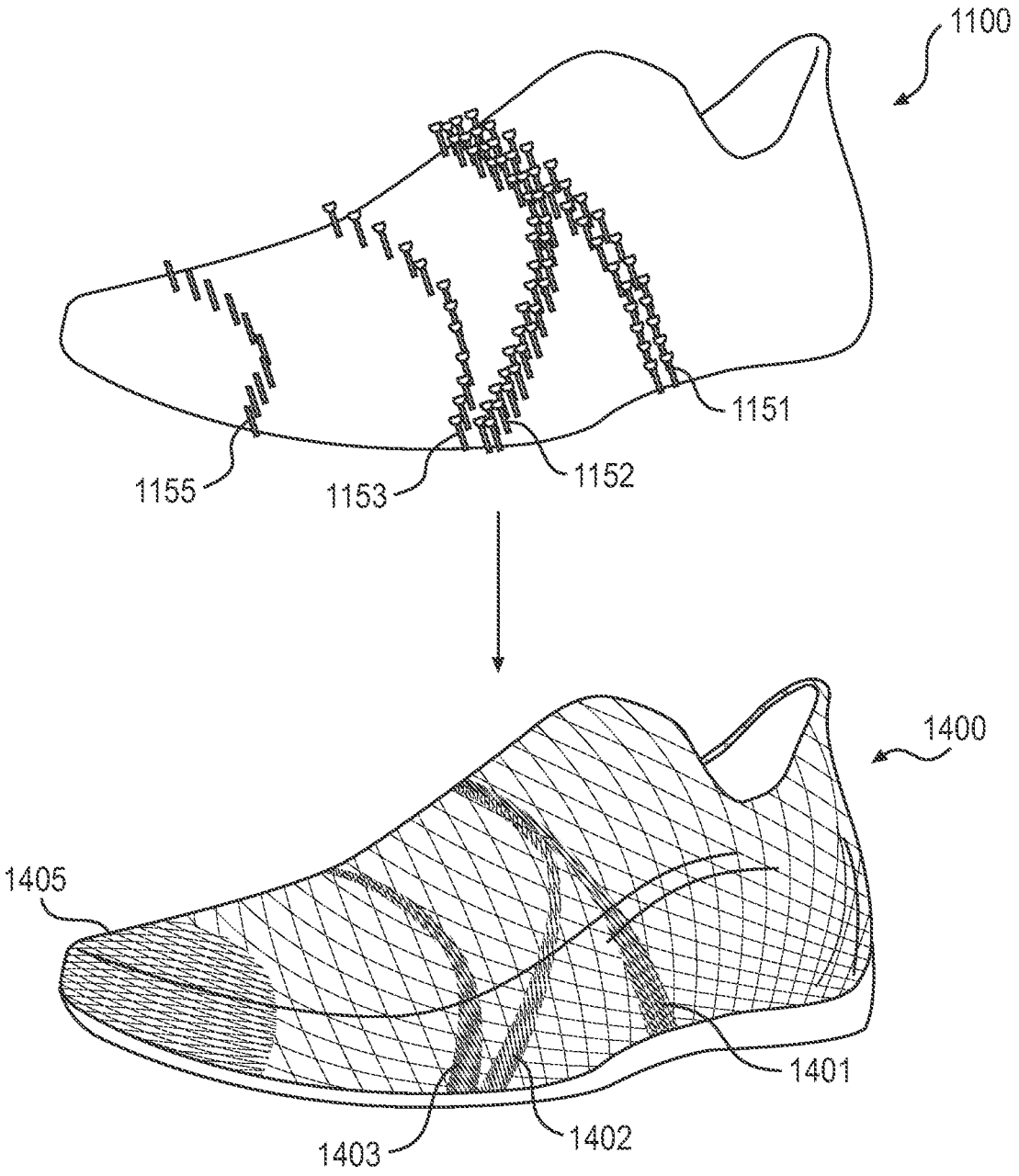
FIG. 26 is a schematic diagram illustrating yet another embodiment of a braided upper for an article of footwear and a last that could be used to manufacture that embodiment.

FIGS. 24-26 illustrate exemplary embodiments of a particular arrangement of pins on a footwear last and a corresponding braided upper that may be manufactured with that particular arrangement of the pins. For example, FIG. 24 illustrates an upper 1200 with eyelets 1201 formed using a last 1100 with pins 1130. In particular, pins 1130 have been placed on last 1100 in a configuration that corresponds with a typical eyelet pattern for footwear. The resulting eyelets 1201 are then formed as the yarns of upper 1200 are braided around pins 1130 during the over braiding process. In another example, FIG. 25 illustrates an upper 1300 formed with different density bands. In particular, upper 1300 includes a high density band 1301 at the forefoot, which is formed by two rows of pins 1140 at the forefoot of a last 1100. Upper 1300 may also include a high density band 1305 in a toe region, which is formed by demarcating the toe region by one row of pins 1141 on last 1100. As still another example, FIG. 26 illustrates an upper 1400 with band 1401, band 1402, band 1403 and band 1405. These bands have been formed using the illustrated configuration of pins 1151, pins 1152, pins 1153 and pins 1155 on footwear last 1100, respectively.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An upper for an article of footwear, the upper comprising:

a unitary braided structure forming at least a forefoot region and a midfoot region of the upper, wherein the unitary braided structure comprises a first density of braids forming at least a portion of the midfoot region and at least a portion of the forefoot region, wherein the first density of braids comprises a first braiding pattern in the unitary braided structure, the first density of braids having a first number of strands, and wherein the unitary braided structure further comprises a first band of a second density of braids and a second band of the second density of braids, the first band and the second band each extending across a width of the upper and intersecting in an instep of the upper, wherein the second density of braids comprises a second braiding pattern in the unitary braided structure, the second density of braids having a second number of strands greater than the first number of strands, and further wherein the first braiding pattern includes a more open structure compared to the second braiding pattern.

2. The upper of claim 1, wherein the first band and the second band each extends from a sole of the article of footwear on a lateral side to the sole on a medial side.

3. The upper of claim 2, wherein the first band extends from the sole on the lateral side at the forefoot region to the sole on the medial side at the midfoot region.

4. The upper of claim 3, wherein the second band extends from the sole on the lateral side at the midfoot region to the sole on the medial side at the forefoot region.

5. The upper of claim 1, wherein the midfoot region has an apex in the instep of the upper, and wherein the first band and the second band intersect at the apex of the midfoot region.

6. The upper of claim 1, wherein the unitary braided structure further comprises a third band of a third density of braids in the forefoot region, the third density of braids having a third number of strands, the third band extending laterally from a lateral side of the article of footwear to a medial side of the article of footwear, and wherein the third number of strands is higher than the first number of strands.

7. The upper of claim 6, wherein the third band does not intersect with the first band or the second band.

8. The upper of claim 6, wherein the unitary braided structure further forms a toe region and comprises a fourth density of braids forming the toe region, the fourth density of braids having a fourth number of strands, and wherein the fourth number of strand is higher than the first number of strands.

9. An upper for an article of footwear, the upper comprising:

a unitary braided structure forming at least a forefoot region and a midfoot region, the midfoot region comprising an apex between a lateral side of the upper and a medial side of the upper;

wherein the unitary braided structure comprises a first density of braids forming at least a portion of the midfoot region and at least a portion of the forefoot region, wherein the first density of braids comprises a first braiding pattern in the unitary braided structure, the first density of braids having a first number of strands, wherein the unitary braided structure further comprises a first band of a second density of braids and a second band of the second density of braids, the first band and the second band each extending from the lateral side of the upper to the medial side of the upper, wherein the second density of braids comprises a second braiding pattern in the unitary braided structure, the second density of braids having a second number of strands greater than the first number of strands, and further wherein the first braiding pattern includes a more open structure compared to the second braiding pattern, and wherein the first band and the second band intersect at the apex of the midfoot region.

10. The upper of claim 9, wherein the first band extends from a sole of the article of footwear on the lateral side at the forefoot region to the sole on the medial side at the midfoot region.

11. The upper of claim 10, wherein the second band extends from the sole on the lateral side at the midfoot region to the sole on the medial side at the forefoot region.

12. The upper of claim 9, wherein the unitary braided structure comprises strands of at least two different materials having different properties.

13. The upper of claim 9, wherein the unitary braided structure further comprises a third band of a third density of braids in the forefoot region, the third density of braids having a third number of strands, wherein the third band extends between the lateral side to the medial side and does not intersect with the first band or the second band, and wherein the third number of strands is higher than the first number of strands.

14. An article of footwear comprising:

an upper comprising a unitary braided structure forming at least a forefoot region, a midfoot region, and a heel region of the upper; and a sole structure secured to the upper, wherein the unitary braided structure comprises a first density of braids forming at least a portion of the midfoot region and at least a portion of the forefoot region, the first density of braids having a first number of strands, wherein the first density of braids comprises a first braiding pattern in the unitary braided structure, and wherein the unitary braided structure further comprises a first band of a second density of braids and a second band of the second density of braids, the first band and the second band each extending across a width of the upper and intersecting in an instep of the upper, the second density of braids having a second number of strands greater than the first number of strands, wherein the second density of braids comprises a second braiding pattern in the unitary braided structure, and further wherein the first braiding pattern includes a more open structure compared to the second braiding pattern.

15. The article of claim 14, wherein the midfoot region has an apex in the instep of the upper, and wherein the first band and the second band intersect at the apex of the midfoot region.

16. The article of claim 15, wherein the first band and the second band each extends from the sole structure on the lateral side to the sole structure on the medial side.

17. The article of claim 14, wherein the unitary braided structure further forms a toe region of the upper and comprises a third density of braids forming the toe region, the third density of braids having a third number of strands, and wherein the third number of strands is higher than the first number of strands.

18. The article of claim 14, wherein the upper further comprises an outer covering over an outer surface of the unitary braided structure and an inner covering disposed on an inwardly facing side of the unitary braided structure.

* * * * *